US005957402A

United States Patent [19]

McEathron et al.

[11] Patent Number: 5,957,402

[45] Date of Patent: Sep. 28, 1999

[54] METHOD AND APPARATUS FOR REDUCING CATENARY DURING WINDING OF A FIBER BUNDLE

[75] Inventors: Eugene D. McEathron, Forest City; Harry Makitka, Clemmons; Robert W. Singer, Bostic, all of N.C.

[73] Assignee: PPG Industries Ohio, Inc., Cleveland, Ohio

[21] Appl. No.: 08/676,284

[22] PCT Filed: Dec. 15, 1994

[86] PCT No.: PCT/US94/14538

§ 371 Date: Oct. 7, 1996

§ 102(e) Date: Oct. 7, 1996

[87] PCT Pub. No.: WO95/20538

PCT Pub. Date: Aug. 3, 1995

Related U.S. Application Data

[63] Continuation-in-part of application No. 08/188,295, Jan. 28, 1994, abandoned.

[51] Int. Cl.[6] ..... B65H 23/18

[52] U.S. Cl. ..... 242/418.1; 242/155 R; 242/364.7; 242/413.3; 242/419.1; 242/563

[58] Field of Search ..... 242/18 G, 40, 242/42, 418, 418.1, 364.7, 413, 413.3, 419.1, 563, 147 R, 155 R

[56] References Cited

U.S. PATENT DOCUMENTS

| | | | |
|---|---|---|---|
| 3,249,412 | 5/1966 | Kolek et al. | 65/3 |
| 3,361,375 | 1/1968 | Kilnk et al. | 242/42 |
| 3,685,764 | 8/1972 | Drummond | 242/129 |
| 3,765,988 | 10/1973 | Schaffer et al. | 156/441 |
| 3,792,821 | 2/1974 | Fallon | 242/42 |
| 3,797,775 | 3/1974 | White | 242/155 M |
| 3,808,789 | 5/1974 | Hurley | 57/58.7 |
| 3,831,880 | 8/1974 | White et al. | 242/156 |
| 3,847,579 | 11/1974 | Fulk et al. | 65/11 |
| 3,861,609 | 1/1975 | Kilnk et al. | 242/45 |
| 3,966,132 | 6/1976 | Gelin et al. | 242/42 |
| 3,966,133 | 6/1976 | Gelin | 242/42 |
| 3,998,326 | 12/1976 | McKee | 206/407 |
| 4,010,908 | 3/1977 | Patterson | 242/42 |
| 4,214,931 | 7/1980 | Wojciechowski | 156/169 |
| 4,413,981 | 11/1983 | White et al. | 474/94 |
| 4,650,133 | 3/1987 | White et al. | 242/45 |
| 5,058,818 | 10/1991 | Haechnel et al. | 242/42 |
| 5,613,642 | 3/1997 | Mulder et al. | 242/42 |

*Primary Examiner*—William Stryjewski
*Attorney, Agent, or Firm*—Ann Marie Cannoni

[57] ABSTRACT

The present invention relates to a method and apparatus for reducing catenary during winding of a fiber bundle which includes a plurality of fiber strands into a wound package. The method includes: applying substantially equal tension to each of a plurality of fiber strands; gathering the strands to form a bundle; advancing the bundle at a predetermined speed and tension toward a winding device; measuring the tension of the bundle; adjusting the tension of the bundle by adjusting the speed at which the bundle is advanced, such that (1) the speed of advancement of the bundle is increased when the measured tension of the bundle exceeds a predetermined value and (2) the speed of advancement of the bundle is decreased when the measured tension of the bundle is less than a second predetermined value; and winding the bundle to form a wound package. The apparatus includes a frame; a plurality of fiber strand supply packages; a plurality of tensioning devices for applying substantially equal tension to each of the fiber strands; a gathering device for gathering the fiber strands into a fiber bundle; a feed device for advancing the fiber bundle at a predetermined speed to a winding device; a tension sensing device for determining the tension in the bundle and providing a signal to a feed device controller which adjusts the speed of the feed device in response to the signal from the tension sensing device; and a winding device.

41 Claims, 12 Drawing Sheets

METHOD AND APPARATUS FOR REDUCING CATENARY DURING WINDING OF A FIBER BUNDLE

RELATED APPLICATION

This patent application is a continuation-in-part of U.S. patent application Ser. No. 08/188,295, filed Jan. 28, 1994, now abandoned.

FIELD OF THE INVENTION

The present invention relates to a method and apparatus for reducing catenary during winding of a fiber bundle and, more particularly, for reducing catenary during winding of a bundle of fiber glass strands into a wound roving package.

BACKGROUND OF THE INVENTION

Variations in tension during winding of a package of a multi-strand material or bundle, such as fiber glass roving, are a significant problem. Fluctuations in tension during winding can cause variations in package density, implosion or telescoping of packages, non-uniform package ends and tangling of the roving during payout. Tension variations and geometry effects during winding are believed to contribute to catenary or sag of multi-strand material. Typical fiber glass rovings can sag about 15 to about 25 centimeters (cm) (about 6 to about 10 inches) over a 15 meter (50 foot) length. This sag can interfere with machinery and/or other nearby rovings and cause undesirable process interruptions.

Various attempts have been made to control bundle tension during winding. For example, U.S. Pat. No. 3,966,133 discloses a tension controlling apparatus in which roving wraps alternately under and over a series of parallel tensioning bars. During the winding process, the yieldable biasing force of the upper tensioning bars can be adjusted to regulate the roving tension in response to increased roving package diameter.

U.S. Pat. No. 3,765,988 discloses an apparatus for packaging linear material. Tension control means are located adjacent each supply package for maintaining equal tension between each strand withdrawn from each package. The strands are wrapped about a major portion of the circumference of a motor-driven feed roll having manually adjustable guide rolls for regulating the length of strand contacting the feed roll. When the strand loses tension, the biased pivotable arm of the winder engages a limit switch which de-energizes the winder motor.

U.S. Pat. No. 3,792,821 discloses a method and apparatus for packaging a composite roving. The tension of each roving can be adjusted. The rovings are fed through rotatable pulleys and guide means to a pull roll driven by a motor at a substantially constant speed. The rovings wrap around a major portion of the circumference of the pull roll, about a cooperating nip roll, and to a guide member carried upon a pivotally supported tension control arm of a winder. Breakage of any of the rovings causes the corresponding pulley to cease rotation and signals the apparatus to stop the winding process.

U.S. Pat. No. 3,808,789 discloses a system for twisting yarns. Individual strands from supply packages are passed through a feed mechanism consisting of three parallel drive rollers and two idler rollers staggered between and biased downwardly into contact with the drive rollers, causing the strands to wrap around a portion of the circumference of each roller. Variations in the strand tension are then sensed and compensated for by adjustment of the feed roller speed.

The strands are fed to a strand separator, through a balloon zone, conventional tension compensating system and a winder.

The LEESONA "Catenary-free" tow winder Models 995/966, 967 and 968, commercially available from Leesona Division of John Brown Textile Machinery of Burlington, N.C., pass strands through multiple godets to stabilize the strands by tensioning straightness and about a tension arm for tensioning the roving prior to winding. These winders, however, produced unacceptable levels of fuzz when used to process conventional glass fiber bundles.

SUMMARY OF THE INVENTION

One aspect of the present invention relates to an apparatus for reducing catenary during winding of a fiber bundle to form a wound package. The fiber bundle comprises a plurality of fiber strands. The apparatus comprises: a frame adapted to support a plurality of fiber strand supply packages and a plurality of tensioning devices; a plurality of fiber strand supply packages, each supply package permitting withdrawal of a fiber strand wound thereon; a plurality of tensioning devices, each tensioning device receiving a fiber strand withdrawn from a supply package and applying a tension to the fiber strand, wherein the tension applied to each of the fiber strands of the bundle is substantially equal; a gathering device spaced apart from each of the plurality of tensioning devices for gathering the plurality of substantially equally tensioned fiber strands into a fiber bundle; a feed device spaced apart from the frame for receiving the fiber bundle from the gathering device and advancing the fiber bundle at a predetermined speed to a winding device; the winding device being spaced apart from the feed device, the winding device comprising a rotatable packaging collector about which the fiber bundle is wound to form a wound package, the winding device receiving the bundle from the feed device and applying a tension to the bundle; a tension sensing device positioned between the feed device and the winding device for (1) determining the tension in the bundle after the bundle is advanced by the feed device to the winding device and (2) providing a signal to a feed device controller; and the feed device controller being electrically connected to the tension sensing device for receiving the signal from the tension sensing device and adjusting the tension of the bundle by adjusting the speed of the feed device in response to the signal from the tension sensing device.

Another aspect of the present invention is an apparatus for reducing catenary during winding of a fiber bundle to form a package, comprising: (a) a frame adapted to support a plurality of fiber strand supply packages and a plurality of tensioning devices; (b) a plurality of fiber strand supply packages, each supply package permitting withdrawal of a fiber strand wound thereon; (c) a plurality of tensioning devices, each tensioning device receiving a fiber strand withdrawn from a supply package and applying a tension to the fiber strand, wherein the tension applied to each of the fiber strands is substantially equal; (d) a gathering device spaced apart from each of the plurality of tensioning devices for gathering the plurality of substantially equally tensioned fiber strands into a fiber bundle; (e) a feed device spaced apart from the frame for receiving the fiber bundle from the gathering device and advancing the fiber bundle at a predetermined speed to a winding device, the feed device comprising (1) a stationary frame having a guide rail member and a biasing member and (2) a feed device support including a feed device support carriage having mounted thereon the driven feed roll, the nip roll, and the nip roll pressurizing device, the driven feed roll having an axis of rotation which is generally parallel and coplanar to an axis of rotation of the nip roll, the nip roll pressurizing device engaging the nip roll and applying pressure to bias an outer surface of the nip roll against an outer surface of the feed roll to apply pressure to a portion of the bundle passing therebetween, the feed device support carriage being slidably secured to the guide rail member; (f) the winding device spaced apart from the feed device, the winding device comprising a rotatable packaging collector about which the fiber bundle is wound to form a wound package, the winding device receiving the bundle from the feed device and applying a tension to the bundle; and (g) a tension sensing device positioned between the feed device and the winding device for determining the tension in the bundle after the bundle is advanced by the feed device to the winding device, the tension sensing device providing a signal to the winding device, the winding device receiving the signal from the tension sensing device and adjusting a rotational speed of the packaging collector in response to the signal received from the tension sensing device.

In yet another aspect of the present invention, the apparatus comprises: (a) a frame adapted to support a plurality of fiber strand supply packages and a plurality of tensioning devices; (b) a plurality of fiber strand supply packages, each supply package permitting withdrawal of a fiber strand wound thereon; (c) a plurality of tensioning devices, each tensioning device receiving a fiber strand withdrawn from a supply package and applying a tension to the fiber strand, wherein the tension applied to each of the fiber strands is substantially equal; (d) a gathering device spaced apart from each of the plurality of tensioning devices for gathering the plurality of substantially equally tensioned fiber strands into a fiber bundle; (e) a feed device spaced apart from the frame for receiving the fiber bundle from the gathering device and advancing the fiber bundle at a predetermined speed to a winding device, the feed device comprising a feed device support having mounted thereon the driven feed roll, the nip roll, and the nip roll pressurizing device, the driven feed roll having an axis of rotation which is generally parallel and coplanar to an axis of rotation of the nip roll, the nip roll pressurizing device engaging the nip roll and applying pressure to bias an outer surface of the nip roll against an outer surface of the feed roll to apply pressure to a portion of the bundle passing therebetween, the driven feed roll including a drive device selected from the group consisting of a direct current regenerative drive and an alternating current drive having dynamic braking; (f) the winding device spaced apart from the feed device, the winding device comprising a rotatable packaging collector about which the fiber bundle is wound to form a wound package, the winding device receiving the bundle from the feed device and applying a tension to the bundle; and (g) a tension sensing device positioned between the feed device and the winding device for determining the tension in the bundle after the bundle is advanced by the feed device to the winding device, the tension sensing device providing a signal to the winding device, the winding device receiving the signal from the tension sensing device and adjusting a rotational speed of the packaging collector in response to the signal received from the tension sensing device.

Another aspect of the present invention relates to a method for reducing catenary during winding of the above fiber bundle. The method comprises: (a) applying substantially equal tension to each of a plurality of fiber strands; (b) gathering the plurality of fiber strands to form a fiber bundle of generally parallel fiber strands; (c) advancing the fiber bundle at a predetermined speed and tension toward a rotatable collector; (d) measuring the tension of the fiber bundle; (e) adjusting the tension of the fiber bundle by adjusting the speed at which the fiber bundle is advanced, such that (1) the speed of advancement of the fiber bundle is increased when the measured tension of the fiber bundle exceeds a predetermined value and (2) the speed of advancement of the fiber bundle is decreased when the measured tension of the fiber bundle is less than a second predetermined value; and (f) winding the fiber bundle upon a rotatable packaging collector of a winding device to form a wound package.

BRIEF DESCRIPTION OF THE DRAWINGS

The foregoing summary, as well as the following detailed description of the preferred embodiment, will be better understood when read in conjunction with the appended drawings. For the purpose of illustrating the invention, there are shown in the drawings an embodiment which is preferred and an alternative embodiment, it being understood, however, that the invention is not limited to the specific arrangements, methods and instrumentalities disclosed. In the drawings.

DETAILED DESCRIPTION OF THE PREFERRED EMBODIMENTS

Figure 1:
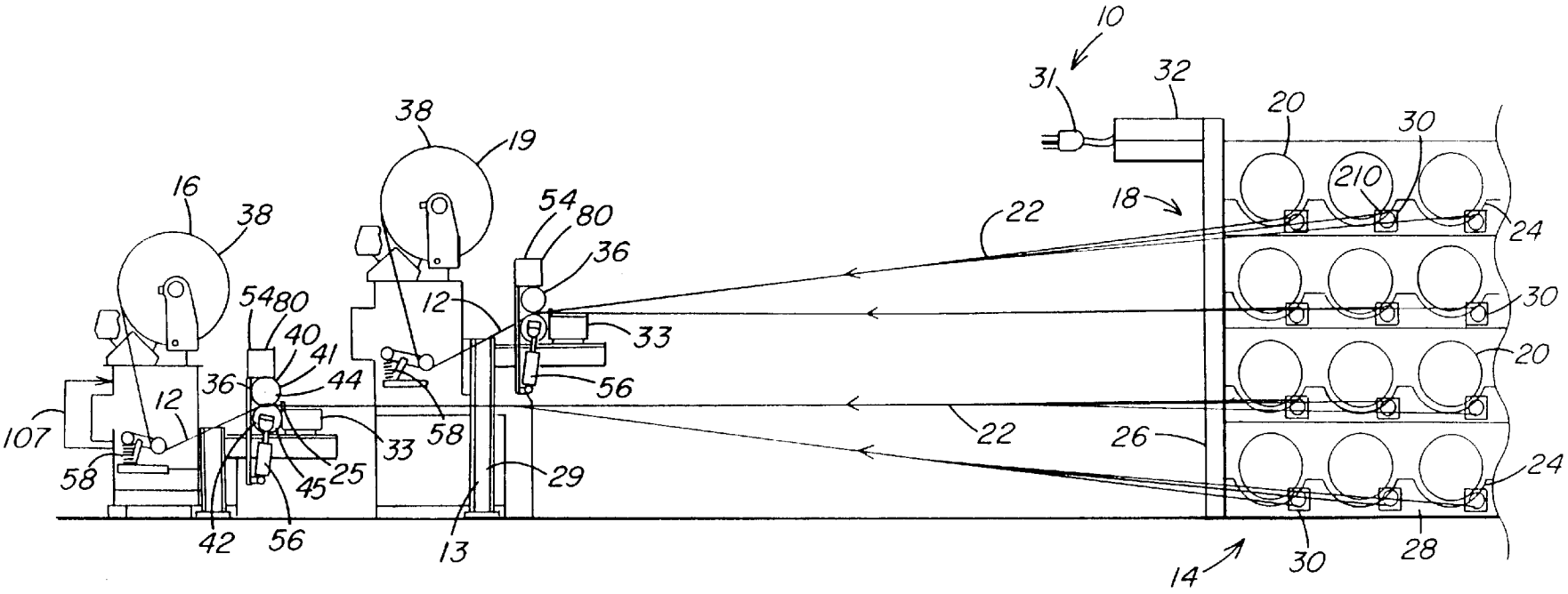
FIG. 1 is a schematic side elevational view of a portion of a preferred apparatus for reducing catenary during winding of a fiber bundle, in accordance with the present invention.

Tension variations in a bundle of multi-strand material during winding produce catenary or sag of the bundle. It has been determined that tension variations between individual strands of the bundle during winding produce differences between the lengths of the strands in a given length of the bundle which contribute to the catenary effect.

The method and apparatus of the present invention reduce tension variations in the bundle and between the individual strands, as well as non-uniform pull on the strands by the winder, thereby reducing the catenary in the bundle and consequent variations in package density, tangling during payout, package collapse and telescoping, and other packaging problems such as those discussed above.

As used herein, the term "bundle" refers to a plurality of strands or ends of material, for example fiber glass strands. The term "strand" as used herein refers to a plurality of fibers or filaments. The present invention is generally useful in the winding of textile bundles, yarns or the like of natural, man-made or synthetic materials. Non-limiting examples of such natural fibers include cotton fibers; man-made fibers include cellulosic fibers such as rayon and graphite fibers; and synthetic fibers include polyester fibers, polyolefin fibers such as polyethylene or polypropylene, and polyamide fibers such as nylon and aromatic polyamide fibers (an example of which is Kevlar™, which is commercially available from E. I. duPont de Nemours Co. of Wilmington, Del.).

The present invention will now be discussed generally in the context of its use in the winding of glass fibers. However, one of ordinary skill in the art would understand that the present invention is useful in the processing of any of the textile materials discussed above.

Glass fibers suitable for use in the present invention include those prepared from fiberizable glass compositions such as "E-glass", "621-glass", "A-glass", "C-glass", "S-glass", "ECR-glass" (corrosion resistant glass) and fluorine and/or boron-free derivatives thereof.

Typically, the surfaces of glass fibers are coated with a sizing composition during the forming process to protect the glass fibers from interfilament abrasion. Typical sizing compositions include as components film-formers such as starch and/or thermoplastic or thermosetting polymeric film-formers and mixtures thereof, lubricants such as animal, vegetable or mineral oils or waxes, coupling agents, emulsifiers, antioxidants, ultraviolet light stabilizers, colorants, antistatic agents and water, to name a few. Examples of suitable sizing compositions are set forth in U.S. Pat. No. 3,249,412, which is hereby incorporated by reference.

The glass fibers are generally gathered into a strand, or end, and wound to form a forming package. The forming packages can be dried, for example, in an oven to reduce the water content and cure any curable components of the sizing composition. A plurality of strands can be combined in parallel form to form a bundle or roving. The bundle can be wound about a collet or tubular support mounted on a winding device to form a wound or roving package.

Referring to the drawings, wherein like numerals indicate like elements throughout, there is shown in FIG. 1 a preferred embodiment of an apparatus, generally designated 10, for reducing catenary during winding of a fiber bundle 12 into a wound or roving package 16, in accordance with the present invention.

As shown in FIG. 1, the preferred apparatus 10 comprises a lower section, indicated generally at 14, for winding a first roving package 16 and an upper section, indicated. generally at 18, for winding a second roving package 19. Apparatus 10, in its preferred configuration, permits simultaneous winding of two separate roving packages. One of ordinary skill in the art would understand that the apparatus 10 of the present invention can comprise a single section, such as lower section 14, for winding one roving package, or two or a plurality of sections for permitting winding of a plurality of wound packages, as desired.

Figure 2:
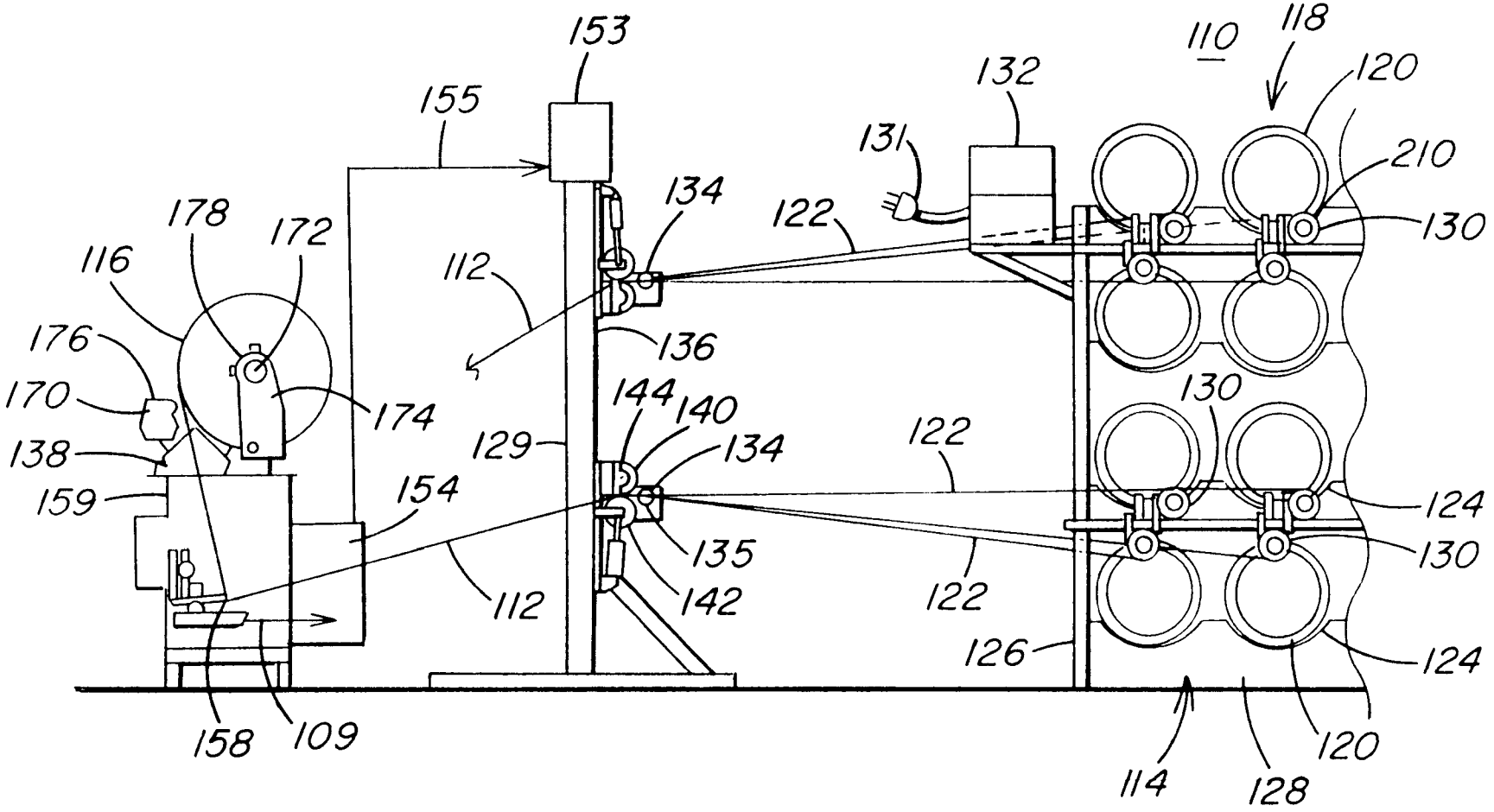
FIG. 2 is a schematic side elevational view of a portion of an alternative embodiment of an apparatus for reducing catenary during winding of a fiber bundle, also in accordance with the present invention.

The alternative apparatus 110 shown in FIG. 2 includes a lower section 114 for winding a first roving package 116 and an upper section 118 for winding a second roving package (not shown). In the alternative apparatus 110, portions of the upper section 118 have been omitted for purposes of clarity in the drawing. This omission is not intended in any way to limit the scope of the present invention.

The present invention will now be discussed generally with reference to lower section 14 of the preferred embodiment of the apparatus 10 shown in FIG. 1.

The apparatus 10 comprises a plurality of fiber strand supply packages 20 or forming packages. Only six of the supply packages 20 of the lower section 14 and six of the supply packages 20 of the upper section 18 of the preferred apparatus 10 are shown in FIG. 1. In the alternative embodiment shown in FIG. 2, four supply packages 120 of the lower section 114 and four supply packages 120 of the upper section 118 are shown. One of ordinary skill in the art would understand that the number of supply packages can be two or more per section, as desired. The preferred number of supply packages 20 is about three to about thirty-three per section, and most preferably about eighteen per section.

As shown in FIGS. 1 and 2, each supply package 20, 120 has at least one fiber strand 22, 122 wound thereon. Each strand 22, 122 comprises a plurality of generally linear fibers, for example continuous glass fibers. Each supply package 20, 120 is typically cylindrically-shaped and has a hollow center which permits withdrawal of the fiber strand 22, 122 from the inside of the supply package 20, 120. The dimensions of the supply package 20, 120 can vary, depending upon such variables as the diameter and type of fiber strand wound thereon, and are generally determined by convenience for later handling and processing. Generally, supply packages 20, 120 are about 15 to about 51 cm (about 6 to about 20 inches) in diameter and have a length of about 5 to about 76 cm (about 2 to about 30 inches). Conventional supply or forming package 20, 120 dimensions are set forth in U.S. Pat. Nos. 3,685,764 and 3,998,326, each of which is hereby incorporated by reference. The sides of the supply package 20, 120 can be tapered as the package is built.

Referring to FIGS. 1 and 2, each supply package 20, 120 is held by a support member 24, 124 of the frame 26, 126 of a creel 28, 128. Conventional creels suitable for use in the present apparatus are shown in K. Loewenstein, *The Manufacturing Technology of Continuous Glass Fibres* (2d Ed. 1983) at page 322.

The apparatuses 10, 110 of the present invention further comprise a plurality of tensioning devices 30, 130. Each tensioning device 30, 130 can be positioned upon the creel 28, 128 adjacent a respective supply package 20, 120. Each tensioning device 30, 130 receives a fiber strand 22, 122 withdrawn from its respective supply package 20, 120 and applies a tension to that fiber strand 22, 122.

It is preferred that at least one of the tensioning devices 30, 130 comprises an magnetic hysteresis brake 210 or magnetic particle brake. The preferred tensioning devices 30, 130 are ACCUTENSE® Model 250 electromagnetic hysteresis brakes or strand tension heads, which are commercially available from Textrol, Inc. of Monroe, N.C.

Figure 3:
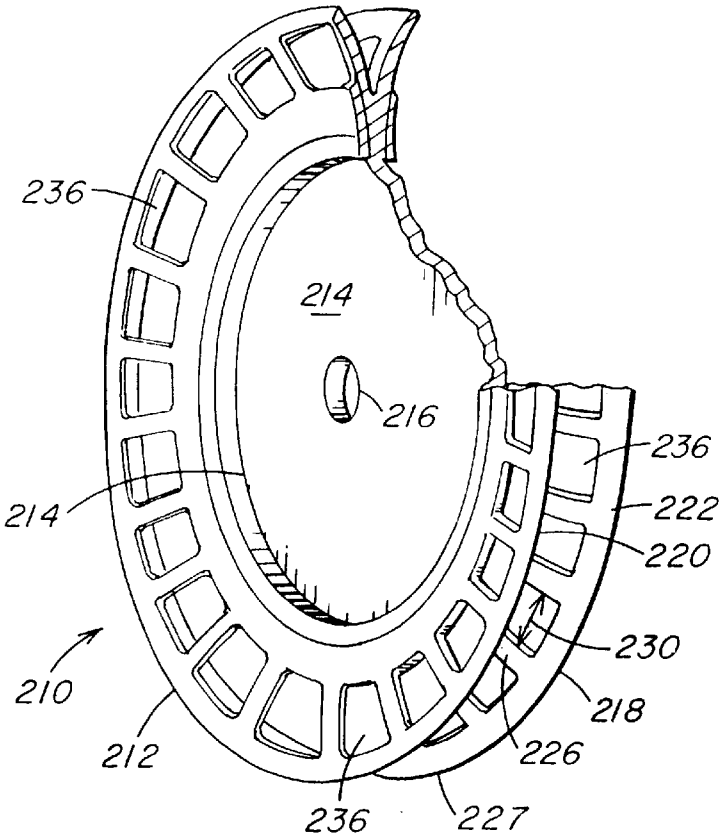
FIG. 3 is a perspective view of a strand engaging wheel of the preferred apparatus.

Referring now to FIG. 3, the magnetic hysteresis brake, indicated generally at 210, includes a strand engaging wheel 212 mounted upon a hub 214 and shaft 216. The hub 214 can be any conventional mounting hub for receiving and retaining a strand engaging wheel. The hub 214 is attached to the shaft 216, which receives and retains the hub 214. Suitable hubs and shafts are available from Textrol, Inc. The tension or braking force applied by the tensioning device 30, 130 to the bundle 12, 112 as it is withdrawn from the supply package 20, 120 by the winding device can be controllably varied, for example, by changing the flux density of the controlling electromagnetic field, as disclosed in U.S. Pat. No. 3,797,775, which is hereby incorporated by reference.

Figure 5:
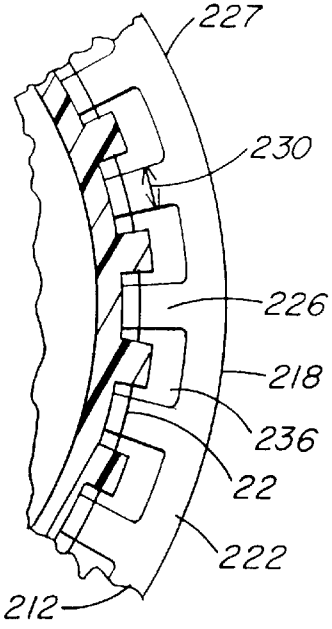
FIG. 5 is a cross-sectional view of the strand engaging wheel of FIG. 4, taken along lines 5—5.
Figure 4:
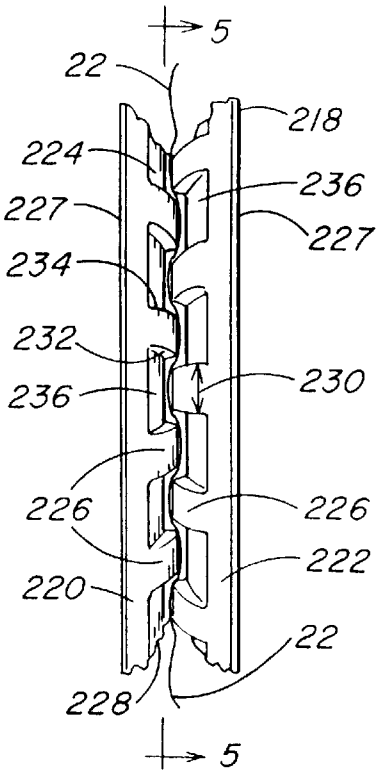
FIG. 4 is a partially broken-away top plan view of the strand engaging wheel of the preferred apparatus.

As shown in FIGS. 3–5, the preferred strand engaging wheel 212 comprises a generally annular body 218 including opposing sidewalls 220, 222. The sidewalls 220, 222 are angled with respect to each other at an angle less than 180°, and more preferably less than about 90°. In the preferred strand engaging wheel 212, the sidewalls 220, 222 are at about a 20° to about a 50° angle to each other, and more preferably about 40° to about 42°. The sidewalls 220, 222 converge to form a groove 224 about the periphery of the strand engaging wheel 212.

Referring to FIGS. 4 and 5, the sidewalls 220, 222 have a plurality of alternating, spaced-apart, tapered strand gripping abutments 226 projecting inwardly to provide a generally serpentine strand path 228. The abutments 226 are spaced-apart to provide a strand path 228 which is preferably less than about 50 percent discontinuous, and more preferably less than about 20 percent discontinuous. Factors such as the discontinuity of the strand path 228, choice of material for forming the abutments 226, length of the strand path 228 which contacts the strand 22, speed of rotation of the strand engaging wheel 212, to name a few, determine the tension imparted to the strand 22 as the strand 22 is withdrawn from the supply package 20 by the winding device 38.

Each abutment 226 can be tapered toward the periphery 227 of the strand engaging wheel 212 to facilitate insertion of the strand 22 between the sidewalls 220, 222. Each abutment 226 has a width 230 and a pair of sides 232, 234, which can be tapered to lessen abrasion to the strand 22. The width 230 of the abutments 226 can be about 5 to about 10 percent of the strand path 228 about the entire circumference of the wheel 212. The number of abutments 226 is generally about 18 to about 36 per sidewall 220, 222. One of ordinary skill in the art would understand that the width, spacing between, number and configuration of the abutments can be varied based upon such factors as the tension desired to be imparted to the strand, the circumference of the strand engaging wheel 212, etc.

As best shown in FIG. 5, a portion of each sidewall 220, 222 between the abutments 226 has an opening 236 therethrough for providing access to the strand path 228. The size and shape of the openings 236 can be varied as desired to permit easy removal of debris and broken strands and filaments from the strand path 228, as long as the sidewalls 220, 222 retain sufficient structural integrity. In the preferred embodiment, the openings 236 roughly span the distance between the abutments 226.

The preferred strand engaging wheel 212 is formed of a resilient elastomeric material such as polyurethane, for example by molding. It is also preferred that the strand engaging wheel 212 be formed as a single unitary member from the same material for ease of fabrication, enhanced structural integrity and economy. The strand engaging wheel 212, however, can alternatively be formed from a combination of different materials or as a combination of separately formed parts, for example separately formed abutments attached to concentric rings.

The strand engaging wheel 212 can alternatively be any conventional tension control wheel, such as, for example, an AccuGrip wheel which is commercially available from Textrol, Inc.

The tension applied to the fiber strand 22 can be varied by varying direct current (DC) voltage input to the tensioning device 30, 130. Referring now to FIGS. 1 and 2, each of the tensioning devices 30, 130 is connected to a tensioning device controller 32, 132 which regulates the power supply 31, 131 and thereby the tension being applied to each fiber strand 22, 122 by each tensioning device 30, 130, such that substantially the same tension is applied to each fiber strand 22, 122. Preferably, the tensioning device controller 32, 132 includes means to sense breakage or entangling of a strand 22, 122 and signal the operator 97, winding device 38 or other components of the apparatus 10, 110 to stop the winding operation.

The preferred controller 32, 132 is a conventional two-step controller, such as the AccuPower variable voltage regulated power supplier which is commercially available from Textrol, Inc. The tensioning devices 30, 130 and controller 32, 132 discussed above are believed to be the subject of U.S. Pat. Nos. 3,797,775, 3,831,880 and 4,413,981, each of which is hereby incorporated by reference.

The tension applied to each fiber strand 22, 122 is preferably about 60 to about 120 grams and, more preferably, about 90 grams with a tension variation of less than about 5 grams. Preferably, the overall variation in tension between each of the strands 22 of the bundle 12 is less than about 10 grams. The ACCUTENSE® Model 250 has a tension range of about 5 to 250 grams (0 to 60 volts DC). The desired tension can differ based upon such variables as the type of multi-strand material, strand diameter, coating on the strand, etc.

The apparatus 10, 110 comprises a gathering device for gathering the plurality of substantially equally tensioned fiber strands 22, 122 into a fiber bundle 12, 112. The gathering device can be spaced-apart from the frame 26, 126 to minimize the converging angles of the strands 22, 122 to be gathered into the bundle 12, 112 and to prevent broken strands 22, 122 from being entrained into the package 16, 116.

As shown in the preferred embodiment in FIGS. 1 and 6–8, the gathering device preferably comprises a fiber oscillating device 33 for oscillating the fiber bundle 12 across at least a portion 41 of the outer surface 44 of the driven feed roll 40 and a corresponding portion 25 of the outer surface 45 of the nip roll 42. The driven feed roll 40 and nip roll 42 are included in the feed device 36 discussed in detail below.

Figure 6:
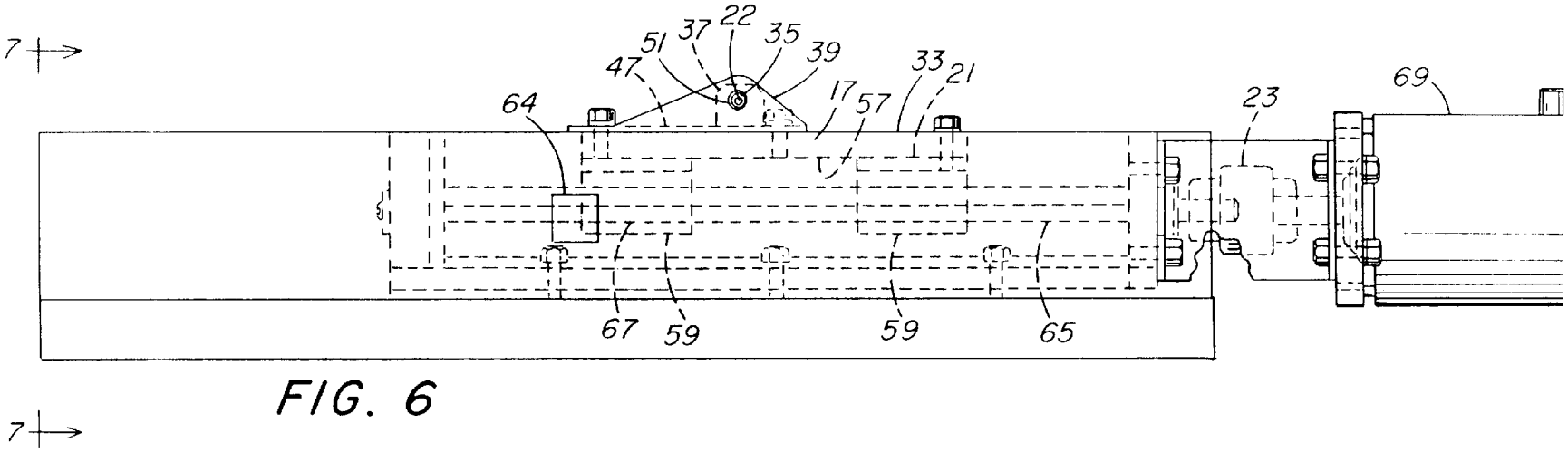
FIG. 6 is a rear elevational view of a fiber bundle oscillating device of the preferred apparatus.
Figure 7:
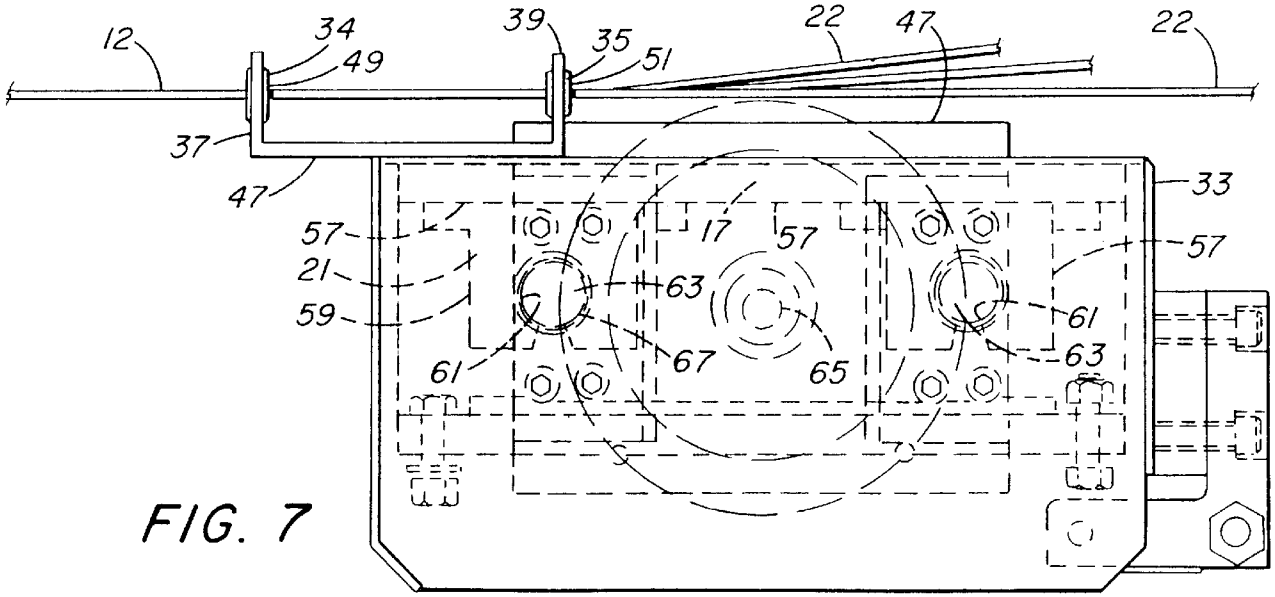
FIG. 7 is a side elevational view of the fiber bundle oscillating device of FIG. 6, taken along lines 7—7.

Referring now to FIGS. 6 and 7, the fiber oscillating device 33 can include a pair of parallel, spaced-apart gathering guide eyes 34, 35. The guide eyes 34, 35 are aligned such that the bundle 12 which passes therethrough is oriented generally perpendicularly to the rotational axes 46, 48 of the feed roll 40 and nip roll 42 (see FIG. 9). Each guide eye 34, 35 is mounted upon a respective vertical supporting member 37, 39. The vertical supporting members 37, 39 are connected by a horizontal supporting member or plate 47.

The vertical supporting members 37, 39 and horizontal supporting member 47 can be formed from a rigid material such as stainless steel, carbon steel or aluminum and are preferably formed as an integral unit.

The distance between the guide eyes 34, 35 is preferably about 5 cm to about 15 cm, and more preferably about 7.62 cm (about 3 inches), although the distance can be varied as desired depending upon such factors as the strand diameters and number of strands for example. It is preferred that the guide eye 34 located closest to the feed device 36 be positioned as close to the feed device 36 as possible to prevent separation of the individual strands prior to entering the feed device 36.

Each guide eye 34, 35 has an aperture 49, 51 therethrough through which the plurality of strands 22 are threaded and gathered into a bundle 12. Each aperture 49, 51 is preferably circular to reduce strand abrasion and can have a diameter of about 3 mm to about 7 mm.

As shown in FIGS. 6 and 7, the horizontal supporting member 47 is connected to a conventional driven slider mechanism for translational movement generally perpendicularly to the rotational axes 46, 48 of the feed roll 40 and nip roll 42. Suitable slider mechanisms are available under the trademark SIMPLICITY™ linear slides from Pacific Bearing Co. of Rockford, Ill. The preferred slider mechanism 21 comprises a support plate 17 connected to the horizontal supporting member 47 by conventional connecting means such as screws and lockwashers. As shown in phantom in FIGS. 6 and 7, the underside 57 of the support plate 17 includes two pairs of generally parallel support brackets or pillow block assemblies 59. Each pillow block assembly 59 has linear bearings 67 and includes a groove 61 which slidably receives a guide rail 63. The support plate 17 is supported by a ball screw 65 and the pillow block assembly 59. The preferred slider mechanism 21 is available as SIMPLICITY™ linear slide Model No. 2RPS-10-012.

The ball screw 65 is rotated through a coupling 23 by a motor 69 and thereby moves the plate 17. The direction of rotation of the ball screw 65 is reversed when the member 64 contacts sensing devices or proximity switches 71, 73 (see FIG. 8).

A suizable coupling 23 is a Sure-Flex Type J coupling which is ccmmercially available from T. B. Wood's Sons Co. of Chambersburg, Pa. The preferred motor 69 is a SLO-SYN synchronous 72 rpm, 120 V alternating current (AC) single phase reversible motor which is commercially available from Superior Electric of Briston, Conn., although any conventional reversible motor can be used.

In the alternative embodiment shown in FIG. 2, the gathering device can comprise a gathering guide eye 134 and, more preferably, a guide eye 134 having a generally circular aperture 135 of about 0.5 cm (about 3/16 inch) diameter. It is understood that the above-described fiber oscillating device 33 can be used in the alternative embodiment shown in FIG. 2. Also, any conventional fiber oscillating device which is capable of oscillating the bundle 12 across the outer surfaces 44, 45 of the feed roll 40 and nip roll 42 can be used in the present invention.

Figure 8:
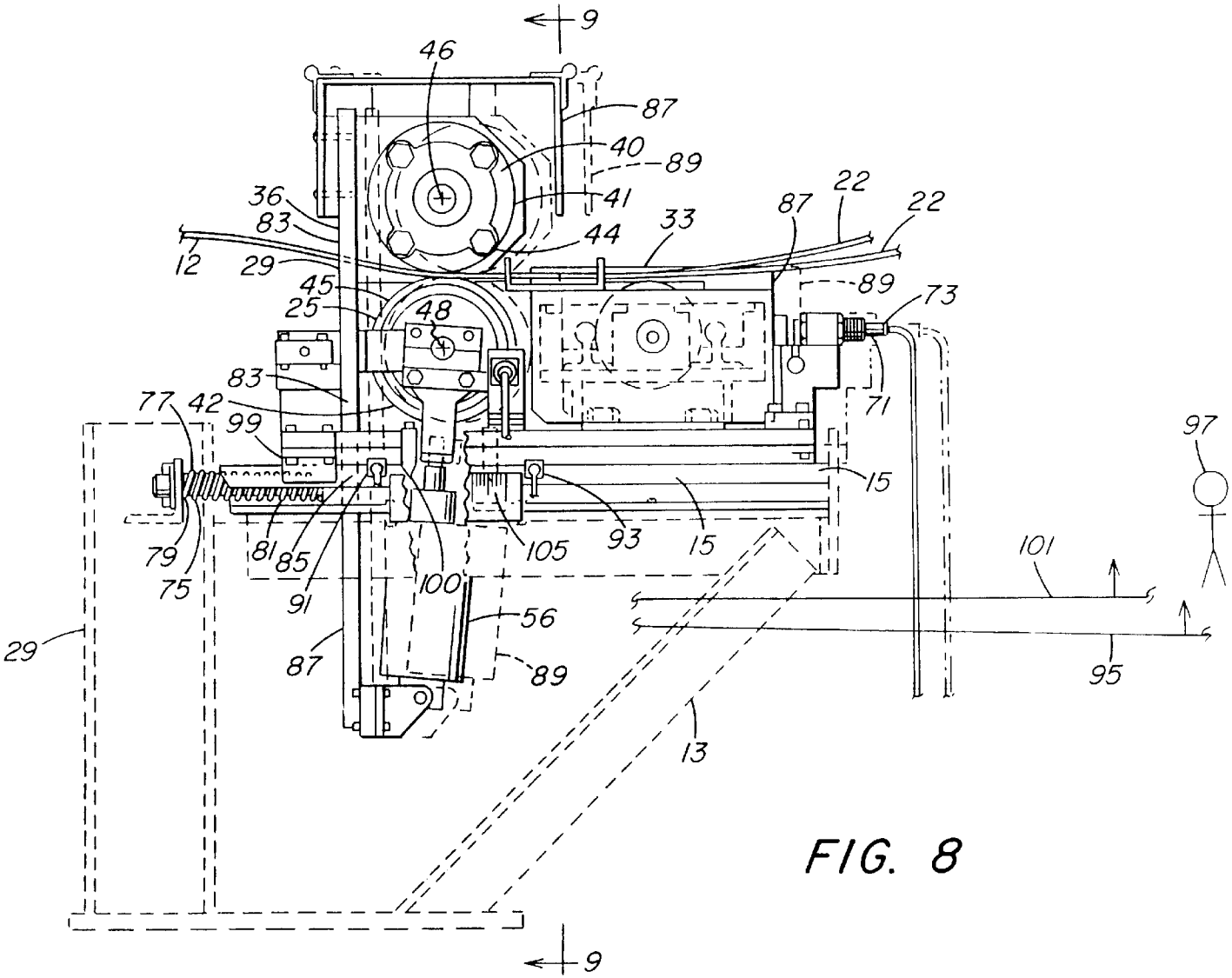
FIG. 8 is a side elevational view of a portion of a feed device of the preferred apparatus.

As shown in FIG. 8, it is preferred that the gathering or fiber oscillating device 33 be positioned so as to gather the fiber strands 22 into the bundle 12 as near to the feed device 36 of the apparatus 10 as possible to maintain bundle integrity.

As shown in FIGS. 1 and 2, the apparatus 10, 110 further comprises a feed device 36, 136 for advancing the fiber bundle at a predetermined speed to a winding device 38, 138.

Referring now to FIGS. 8–11, the feed device 36, 136 comprises a driven feed roll 40, 140 for advancing the fiber bundle 12, 112 and a cooperating nip roll 42, 142 for applying pressure to the fiber bundle 12, 112 in a direction generally perpendicular to an outer surface 44, 144 of the driven feed roll 40, 140. The feed device 36, 136 advances the fiber bundle 12, 112 without significant wrapping of the bundle 12, 112 around the feed rolls 40, 140 or nip rolls 42, 142 of the feed device 36, 136.

Figure 9:
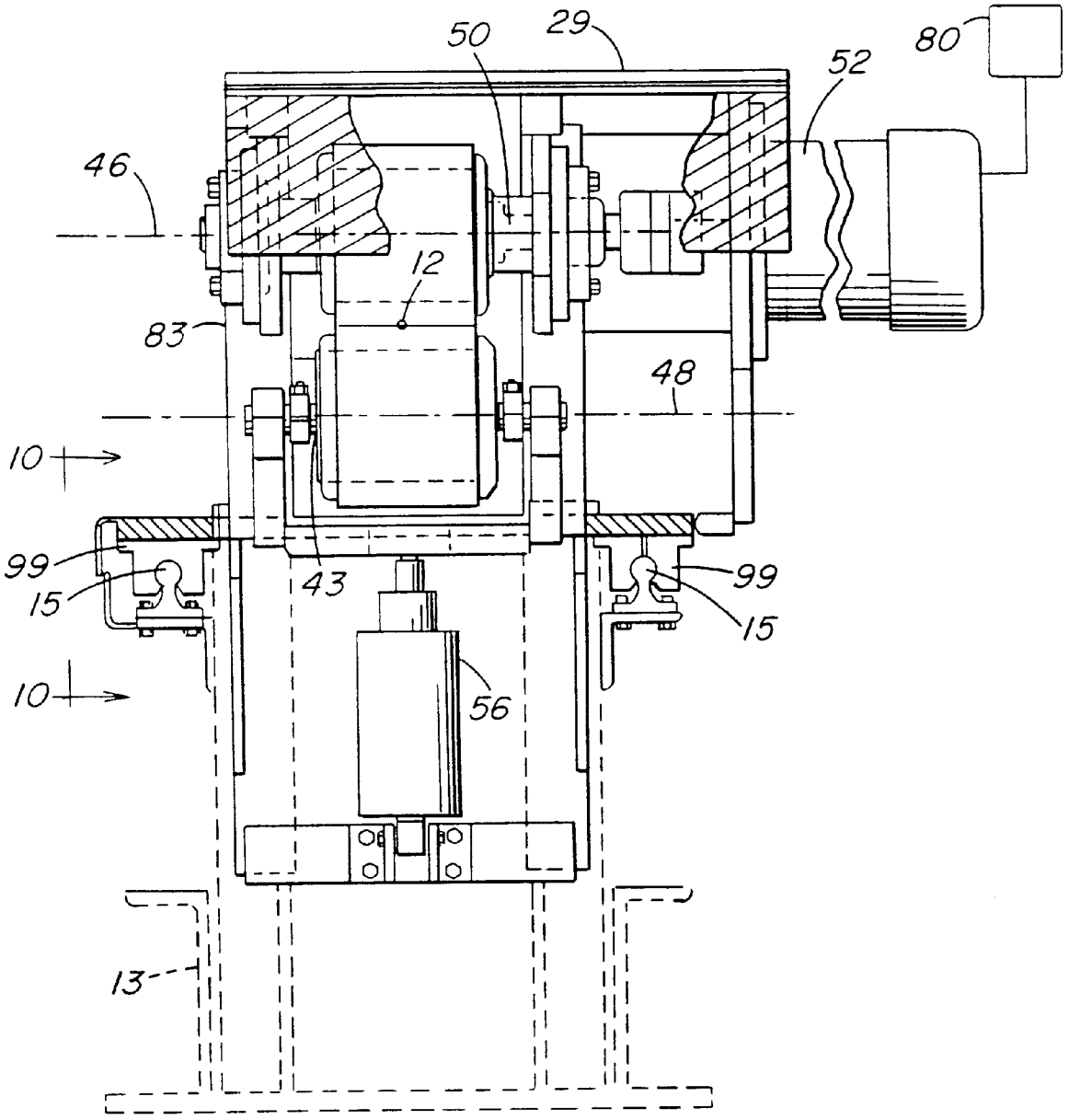
FIG. 9 is a cross-sectional view taken along line 9—9 of the portion of the feed device of FIG. 8.
Figure 11:
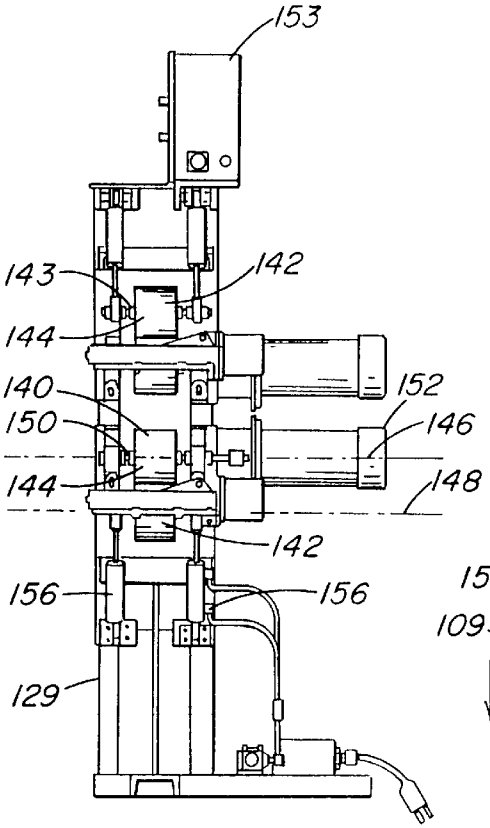
FIG. 11 is a front elevational view of the feed device of FIG. 10.
Figure 10:
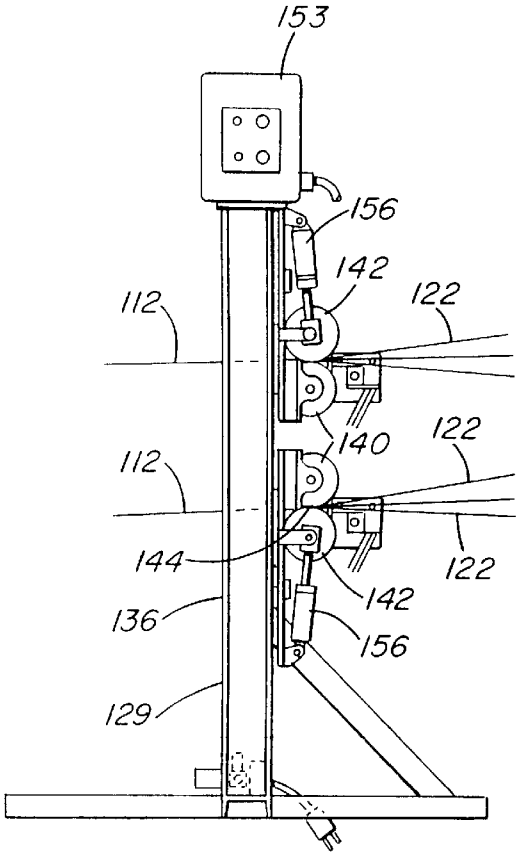
FIG. 10 is a side elevational view of a feed device of the alternative embodiment.

Both the driven feed roll 40, 140 and the nip roll 42, 142 are mounted upon a feed device support 29, 129 which permits free rotation of the rolls 40, 140 and 42, 142 in a direction generally parallel to the direction of advancement of the bundle 12, 112. The feed device support 29, 129 is preferably positioned to minimize the angle between incoming strands 22, 122 and the region of contact between the feed and nip rolls 40, 140 and 42, 142. The axis 46, 146 of rotation of the feed roll 40, 140 and the axis 48, 148 of rotation of the nip roll 42, 142, shown in FIGS. 9 and 11, are generally parallel and coplanar.

In the preferred embodiment, the feed roll 40 is driven by a feed drive device 80 and conventional motor 52 through drive shaft 50. The feed drive device 80 is preferably a regenerative direct current (DC) drive or an alternating current (AC) drive with dynamic braking. The feed drive device 80 is capable of correcting both positive and negative deviations from a speed setpoint. The feed drive device, therefore, acts as a generator and provides braking torque. Such a device 80 can also be used in the alternative embodiment.

Examples of useful regenerative DC drives are SECO® Quadraline 7000 DC drives, which are commercially available from Warner Control Techniques of Lancaster, S.C. The SECO® Quadraline 7000 DC drive is a full wave, regenerative DC drive which is capable of operating shunt wound or permanent magnet DC motors from ¼ horsepower (HP) to 5 HP. The preferred Quadraline 7000 DC drive is the Q7002 drive having an input line voltage of 230 VAC, ½ to 2 HP, capable of 1750 rpm at full load and having 180 volt armature.

In the alternative embodiment shown in FIG. 2, the drive shaft 150 of the feed roll 140 is driven by a variable speed DC motor 152, preferably a ½ HP 90 volt DC motor which is capable of 1725 rpm at full load. The motor speed is controlled by a feed device controller 154 (shown in FIG. 2), the function of which will be discussed in greater detail below.

For example, for a bundle 12, 112 having fourteen strands, a feed roll speed of about 900 rpm would correlate to a bundle speed of about 335 meters/min (m/min) (about 1100 ft/min). Generally the speed at which the feed device 36, 136 advances the fiber bundle is about 244 to about 366 m/min (about 800 to about 1200 ft/min). For large bundles having more than thirty strands, the tension in the bundle 12, 112 provided by the winding device 38, tensioning devices 30, 130 and nip roll pressure is generally sufficient to maintain the bundle 12, 112 at the desired tension without additional speed increase from the feed roll 40, 140.

In the alternative embodiment, the tension supplied by the feed device 136 to the fiber bundle 112 is up to about 0.8 kilograms (kg) (about 1.8 pounds) when the number of fiber strands in the bundle is less than thirty. When the number of fiber strands in the bundle is thirty or more, the tension supplied by the feed device 136 to the fiber bundle 112 is about 1.2 kg (about 2.7 pounds) when the nip roll pressure is about 413686 $N/m^2$ (about 60 psi). The feed roll 40, 140 speed can be varied by the feed drive device 80 (in the preferred embodiment) or feed device controller 154 (in the alternative embodiment) in response to, for example, changes in the winder speed as the diameter of the roving package 16, 116 increases.

The feed device controller 54 of the preferred embodiment is preferably a conventional programmable logic controller which is capable of activating and deactivating the drive device 80 and motor 52 of the feed device 36. The preferred feed device controller 154 of the alternative embodiment of FIG. 2 is an analog programmable logic controller, such as Allen Bradley SLC-500 with analog output module 1746-NO4V, which is commercially available from Allen Bradley of Milwaukee, Wis. The analog output module provides a signal 155 ranging from 0 to 10 volts to the motor controller 153 to adjust the motor 152 speed in accordance with the SLC-500 program requirements. Other examples of suitable analog controllers for use in the present invention will be evident to those of ordinary skill in the art in view of the present disclosure.

The outer surface 44, 144 of the feed roll 40, 140 provides non-slipping frictional drive when the bundle 12, 112 is under compression from nip roll 42, 142. For example, the outer surface 44, 144 of the feed roll 40, 140, as well as the outer surface of the nip roll 42, 142, can be coated with a non-abrasive, friction material such as a urethane compound to provide these attributes.

The outer surface of the nip roll 42, 142 is biased to contact the outer surface of the feed roll 40, 140 and thereby apply pressure to a portion of the bundle 12, 112 passing therebetween to prevent the strands from slipping.

The nip roll 42, 142 is attached to a nip roll pressurizing device, preferably a piston and cylinder arrangement 56, 156, mounted to the feed device 36, 136. The movement of the piston is regulated by changes in the fluid, such as air or oil, in the cylinder. Preferably, as shown in FIGS. 9 and 11, each of the ends of the shaft 43 of the nip roll 42 are attached to a yoke connected to a single piston and cylinder arrangement 56 or pneumatic air cylinder having a 6.35 cm (2.50 inch) bore and 2.54 cm (1.00 inch) stroke, such as is commercially available from Bimba of Monel, Ill. as Model No. 501-DXP. In the alternative embodiment shown in FIGS. 10 and 11, each of the ends of the shaft 143 of the nip roll 142 are attached to two piston and cylinder arrangements 156, each being an air cylinder having a 3.81 cm (1.5 inch) diameter and a 5.08 cm (2 inch) stroke.

Generally, the pressure applied by the nip roll 42, 142 to the bundle 12, 112 is about 68948 to about 413686 $N/m^2$ (about 10 to about 60 psi). For example, for a bundle consisting of three K-17.3 strands, the pressure exerted by the nip roll 42, 142 would be about 68948 to about 137895 $N/m^2$ (about 10 to about 20 psi). For an eight K-17.3 strand bundle, the pressure would be about 206843 $N/m^2$ (about 30 psi) and for a thirty-one strand bundle, the pressure would be about 413686 $N/m^2$ (about 60 psi). The pressure applied by the nip roll 42, 142 can vary based upon such variables as the strand diameter, strand coating and the number of strands in the bundle, to name a few.

As shown in FIGS. 8 and 9, the feed device 36 can further comprise a stationary frame 13 (shown in phantom). The stationary frame 13 has one or more guide rail members 15 and a biasing member 75. The preferred biasing member 75 comprises a compressible spring 77 having a predetermined spring constant. The spring 77 can be formed from such materials as high carbon steel and stainless steel, for example. The spring constant can be about 525 to about 2627 N/m (about 3 to about 15 pounds per inch), and depends upon such factors as the type and number of strands in the bundle to be wound and the desired tension in the resulting roving package, to name a few.

The preferred compressible spring 77 has a 2.477 cm (0.975 inch) outer diameter, a 10.16 cm (4 inch) uncompressed length and a spring constant of 1086 N/m (6.2 pounds per inch), and is commercially available from Diamond Wire Spring Co. of Taylor, S.C. One of ordinary skill in the art would understand that any suitable biasing member well known to those of ordinary skill in the art, such as a piston and cylinder arrangement similar to that discussed above, can be used as the biasing member. An advantage of the present invention is that biasing members having different resistances can be readily interchanged to permit successive winding of a variety of packages of different tension tolerances.

The first end 79 of the spring 77 is connected to the stationary frame 13. As shown in FIG. 8, the second end 81 of the spring 77 is connected to a feed device support carriage 83 of the feed device support 29 having mounted thereon the driven feed roll 40, the nip roll 42 and the nip roll pressurizing device 56. The feed device support carriage 83 is connected to two pairs of generally parallel support brackets or pillow block assemblies 99. Each pillow block assembly 99 has bearings and includes a groove which slidably receives the corresponding guide rail member 15 and is slidably secured thereto.

Referring to FIG. 8, the feed device support carriage 83 is movable along a length 85 of the guide rail member 15 between a first position 87 and a second position 89 shown in phantom (for purposes of clarity in the drawing, the feed roll 40, nip roll 42 and fiber oscillating device 33 are shown only in outline phantom in FIG. 8). This movement is generally parallel to the direction of travel of the bundle 12. When the tension of the fiber bundle 12 exceeds a first predetermined value, the feed device support carriage 83 moves to the first position 87, causing the compressible spring 77 to compress. When the tension of the fiber bundle 12 is less than this predetermined value, the feed device support carriage 83 moves to the second position 89, causing the spring 77 to return to its uncompressed state or an elongated state.

The first predetermined value of the tension in the fiber bundle 12 is the tension desired to be imparted to the fiber bundle 12 during winding to produce a wound package 16. This value is generally determined by routine experimentation based upon such factors as the number and type of strands 22 in the bundle 12, acceptable amount of catenary or sag in a length of the bundle 12, tension imparted to each of the strands by the tensioning devices, the speed of the bundle and the tackiness of the sizing or binder on the strands to name a few. For example, for a bundle consisting of 31 strands or ends of K17.3 fibers, the first predetermined tension value is about 1.4 kg to about 4.5 kg (about 3 to about 10 pounds), and preferably about 1.4 kg to about 3.9 kg (about 3 to about 8.5 pounds) and more preferably about 1.8 kg to about 2.7 kg (about 4 to about 6 pounds). For a bundle consisting of 4 strands or ends of K-17.3 fibers, the first predetermined tension value is about 0.1 kg to about 0.9 kg (about 0.3 to about 2 pounds), and preferably about 0.2 kg to about 0.7 kg (about 0.5 to about 1.5 pounds).

As shown in FIG. 8, the tension in the bundle 12 is preferably indicated by a simple indicator or pointer 100 which is calibrated to a suitable scale 105 to indicate the tension of the bundle 12. Preparation of such a scale 105 would be within the scope of knowledge of those of ordinary skill in the art in view of the present disclosure and can be determined by routine experimentation.

Alternatively as also shown in FIG. 8, the tension in the bundle 12 can be indicated by the feed device support carriage 83 contacting (1) a first sensing device or first limit switch 91 when the tension of the fiber bundle 12 exceeds a second predetermined value which is greater than the first predetermined value discussed above and (2) a second sensing device or second limit switch 93 when the tension of the fiber bundle 12 is less than a third predetermined value which is less than the first predetermined value discussed above.

When the tension of the fiber bundle exceeds the second predetermined value, the first sensing device or limit switch 91 can provide a signal 95 (shown in FIG. 8) to at least one of an operator 97 and the winder device 38 to deactivate the winding device 38.

When the tension of the fiber bundle 12 is less than the third predetermined value, the second sensing device or limit switch 93 can provide a signal 101 to at least one of the operator 97 and the winder device 38 to deactivate the winding device 38.

The second and third predetermined values of the tension of the fiber bundle 12 are the desired maximum and minimum tension values, respectively, for the specific wound package 16 being prepared. If the tension of the fiber bundle in a package is too high, the payout or unwinding of the strand can be adversely affected. If the tension of the fiber bundle in a package is too low, the package will be soft, lose its integrity and be susceptible to damage during handling and shipping. These values are typically determined by such factors as are set forth above for determining the first predetermined value. For example, for a bundle consisting of 31 strands or ends of K-17.3 fibers, the second predetermined tension value is about 2.3 kg to about 4.1 kg (about 5 to about 9 pounds) and the third predetermined tension value is about 6.8 kg (about 15 pounds). For a bundle consisting of 4 strands or ends of K-17.3 fibers, the second predetermined tension value is about 0.5 kg to about 0.7 kg (about 1 to about 1.5 pounds) and the third predetermined tension value is about 1.4 kg (about 3 pounds).

The signals 95, 101 can be conveyed to the operator 97 audially or visually. For example, a buzzer or bell (not shown) can sound to alert the operator 97 that the tension in the wound package 16 is unacceptably high or low, i.e., out of specifications.

Figure 14:
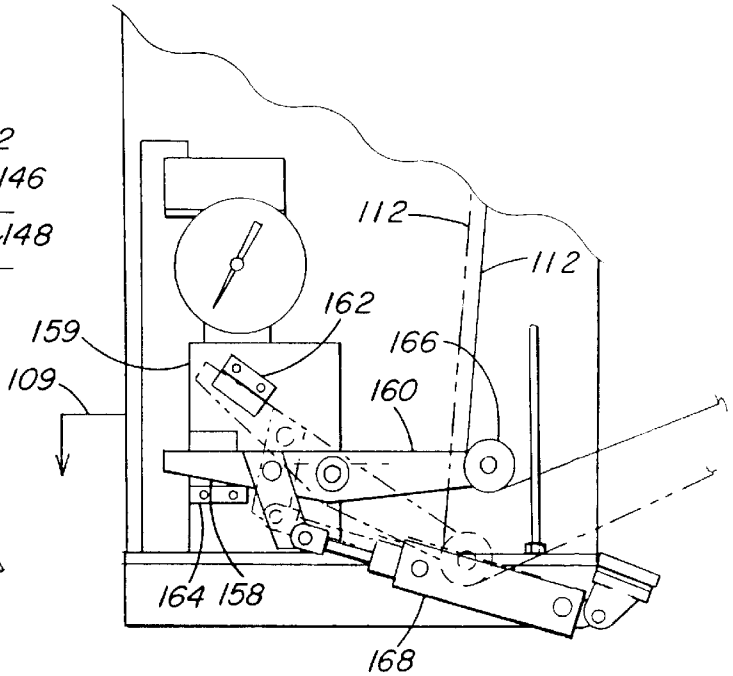
FIG. 14 is a side elevational view of a tension sensing device of the alternative embodiment of the apparatus.
Figure 12:
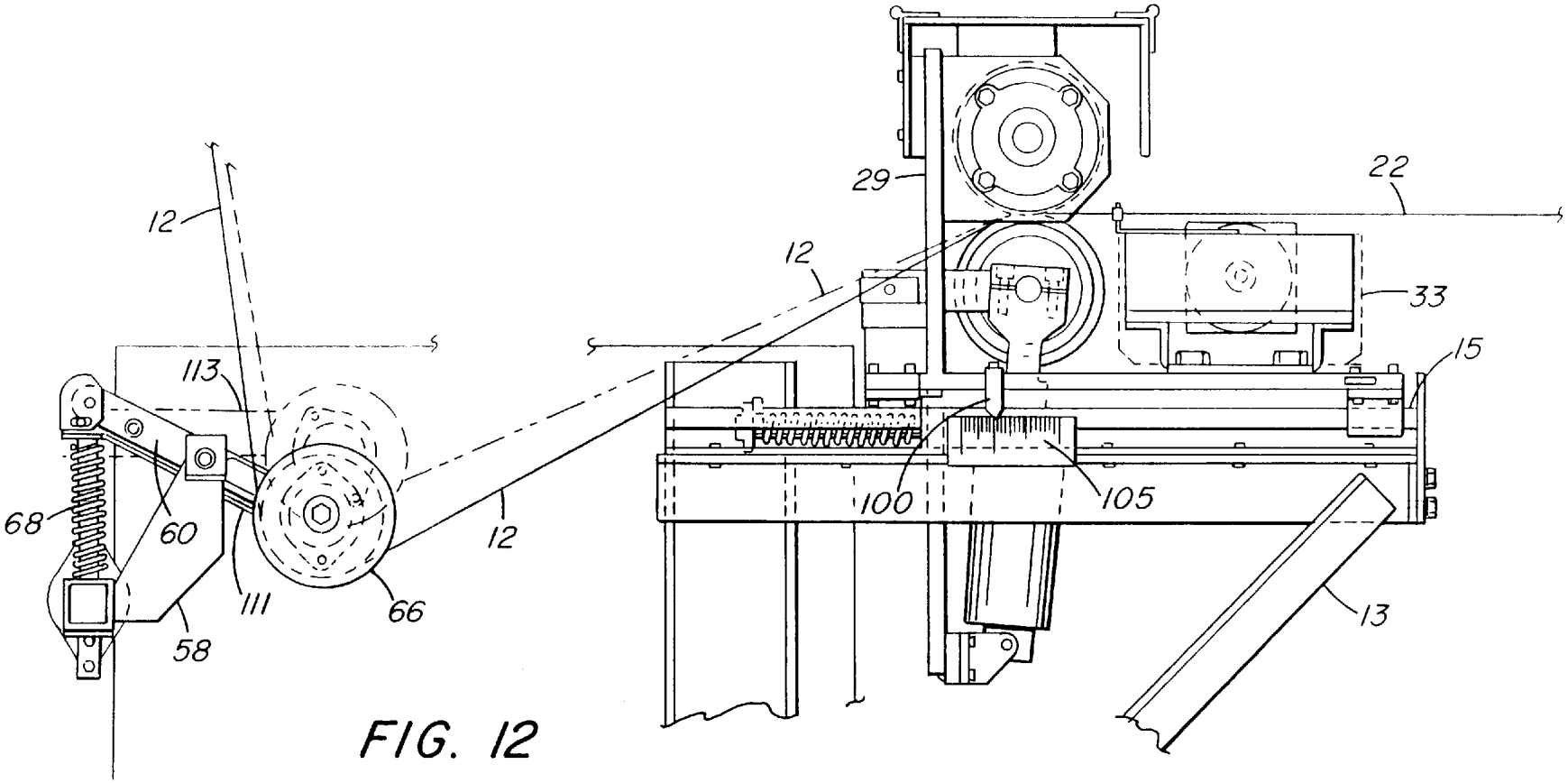
FIG. 12 is a side elevational view of the feed device and a tension sensing device of the preferred apparatus.
Figure 13:
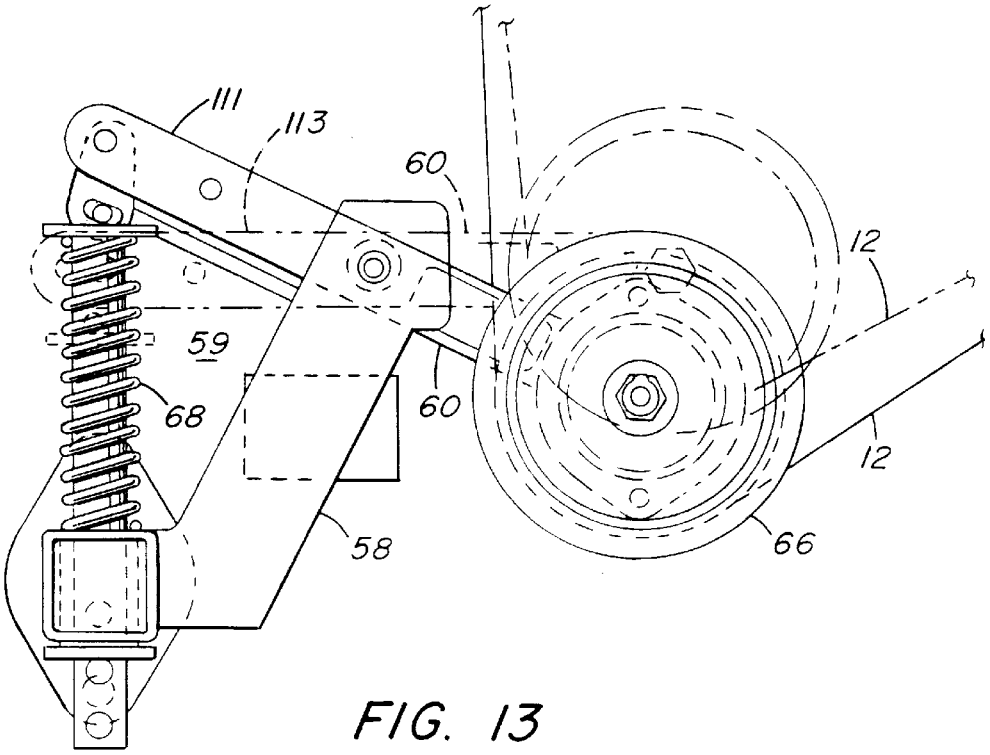
FIG. 13 is a side elevational view of the tension sensing device of FIG. 12.

As best shown in FIGS. 12–14, the apparatus 10, 110 also comprises a tension sensing device positioned between the feed device 36 and the winding device 38 for determining the tension in the bundle 12, 112. The tension sensing device can be attached to the winding device, if desired.

In the preferred embodiment of FIGS. 1, 12 and 13, the tension sensing device provides a signal 107 to the winding device 38 to adjust the rotational speed of the packaging collector or collet 72 of the winding device 38. When the tension sensing device senses that the tension in the bundle 12 is less than a desired value, the tension sensing device signals the winding device 38 to reduce the speed of the winding device 38. Similarly, when the tension sensing device senses that the tension in the bundle 12 is greater than a desired value, the tension sensing device signals the winding device 38 to increase the speed of the winding device 38.

In the alternative embodiment shown in FIGS. 2 and 14, the tension sensing device provides a signal 109 to the feed device controller 154. The embodiment shown in FIG. 1 can also include having the tension sensing device providing a signal to a feed device controller. When the tension sensing device senses that the tension in the bundle 112 is less than a desired value, the tension sensing device signals the feed device controller 154 to reduce the speed of the feed roll 140. Similarly, when the tension sensing device senses that the tension in the bundle 112 is greater than a desired value, the tension sensing device signals the feed device controller 154 to increase the speed of the feed roll 140.

The tension sensing device also minimizes small tension variations in the bundle tension produced by the winding device 38, 138 traversing the roving package 16, 116 during the winding process. It is preferred to minimize the angle between the dancer arm 60 and the contact region of the feed roll 40 and nip roll 42.

In the preferred embodiment shown in FIGS. 1, 12 and 13, the tension sensing device comprises a housing 59 having a dancer arm assembly 58 mounted thereon. The dancer arm assembly 58 comprises a movable or pivotable dancer arm 60 and resistance sensing device or potentiometer 62 (shown in FIG. 15). The resistance sensing device can be any conventional device which is capable of sensing different resistance values.

The dancer arm 60 is pivotable between a first position 111 and a second position 113. When the tension of the bundle 12 is less than a predetermined value, the dancer arm 60 pivots to the first position 111, the potentiometer 62 senses the resistance of the dancer arm 60 in the first position 111 and provides a signal 107 to the tension sensing device and winding device 38 to decrease the speed at which the winding device 38 advances the fiber bundle 12. When the tension of the bundle 12 exceeds a second predetermined value, the dancer arm 60 pivots to the second position 113, the potentiometer 62 senses the resistance of the dancer arm 60 in the second position 113 and provides a signal 107 to the tension sensing device and winding device 38 to increase the speed at which the winding device 38 advances the fiber bundle 12. The desired tension values depend upon such factors as the desired density of the roving package 16, the number of strands 22 in the bundle 12, to name a few, and can be determined by one of ordinary skill in the art in view of the present disclosure by routine experimentation, for example.

In the alternative embodiment, the tension sensing device comprises a housing 159 having a dancer arm assembly 158 mounted thereon, shown in FIG. 14. The dancer arm assembly 158 comprises a movable or pivotable dancer arm 160, a first sensing device or limit switch 162 and a second sensing device or limit switch 164. The first limit switch 162 and second limit switch 164 are preferably conventional magnetic or proximity switches.

The dancer arm 160 is movable between a first position in contact with the first limit switch 162 (shown by a dotted outline) and a second position in contact with the second limit switch 164, such that (1) when the tension of the bundle 112 is below a predetermined value, the dancer arm 160 contacts the first limit switch 162 and the tension sensing device provides a signal 109 to the feed device controller 154 to decrease the speed at which the feed device 136 advances the fiber bundle 112 and (2) when the tension of the bundle 112 exceeds a second predetermined value, the dancer arm 160 contacts the second limit switch 164 and the tension sensing device provides a signal 109 to the feed device controller 154 to increase the speed at which the feed device 136 advances the fiber bundle 112.

Figure 15:
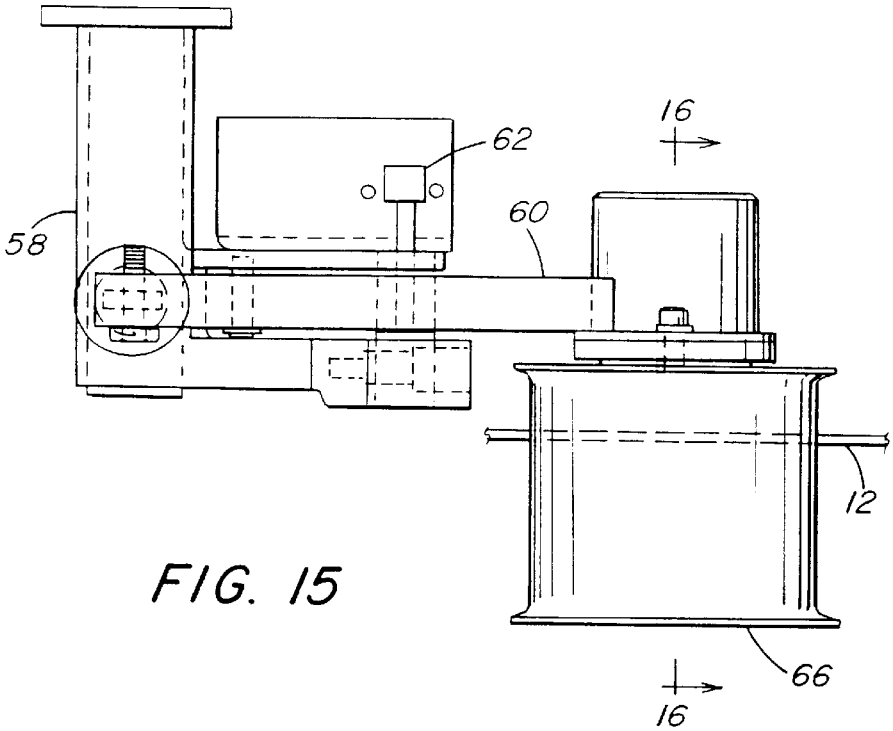
FIG. 15 is a top plan view of the tension sensing device of FIG. 13.
Figure 16:
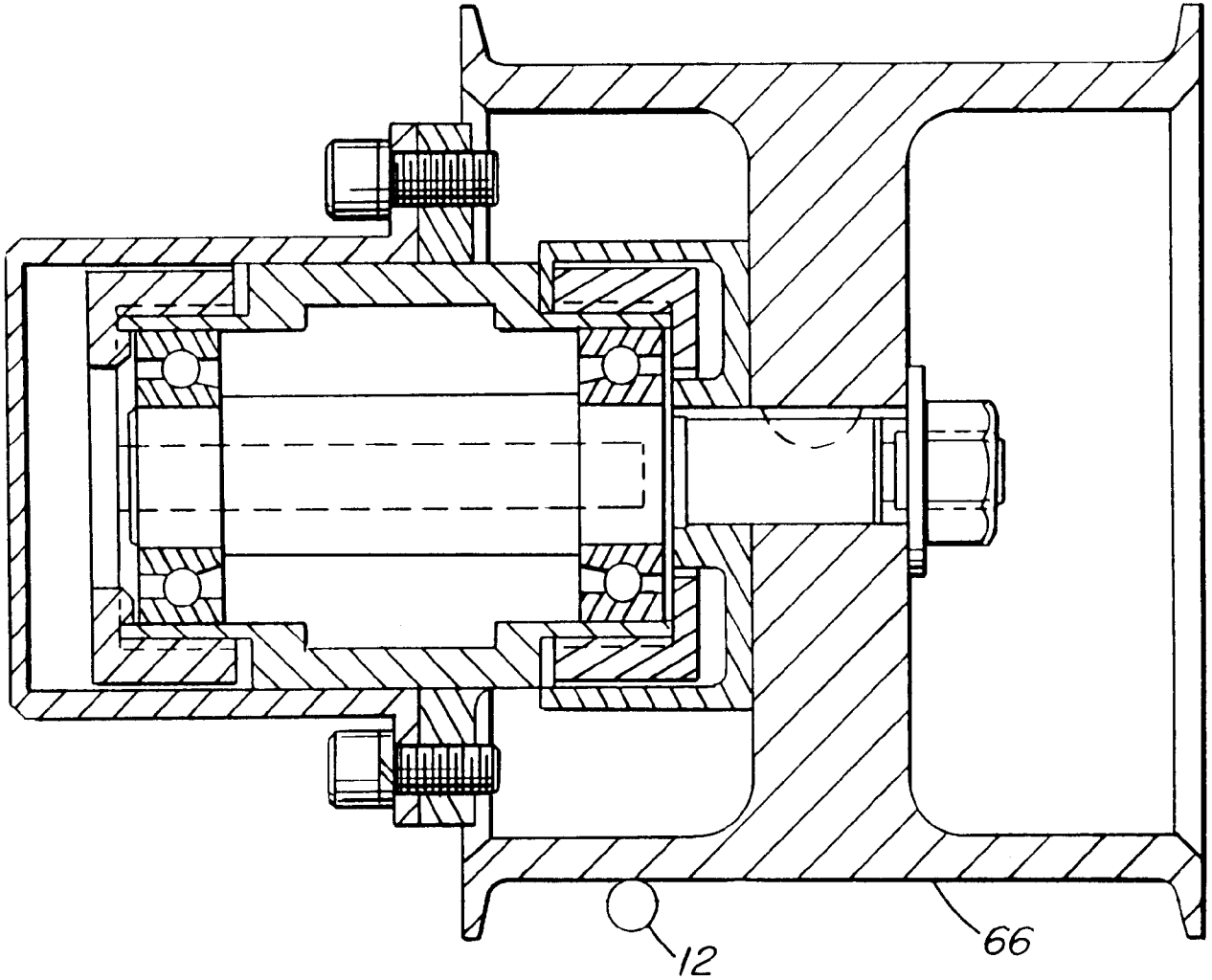
FIG. 16 is a cross-sectional view of the roll of the dancer arm of the tension sensing device of FIG. 15, taken along lines 16—16.
Figure 17:
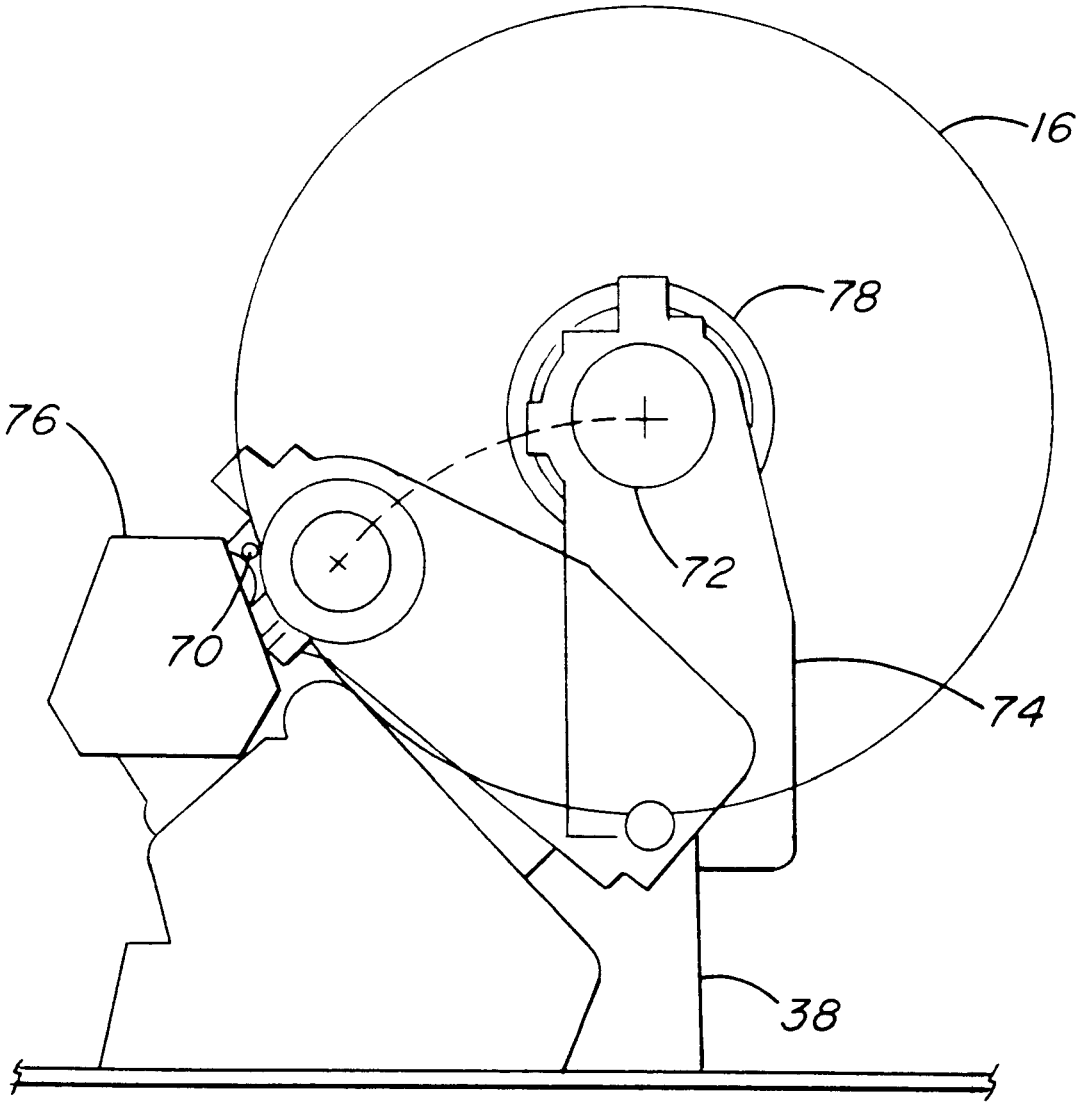
FIG. 17 is a schematic side elevational view of a portion of the winding device of the preferred apparatus.

As shown in FIGS. 15 and 16, the dancer arm 60, 166 can include a roll or spindle 66, preferably a spindle having ball-bearings, about which the bundle 12, 112 is contacted and which rotates freely upon its axis as the bundle 12, 112 advances to the winding device 38, 138.

The dancer arm 60, 160 can be attached to a biasing member for providing a predetermined resistance to the tension of the bundle 12, 112. The desired amount of resistance is selected based upon such factors as desired tension of the bundle in the wound package, number of strands in the bundle, winding speed and strand diameter to name a few, and can readily be determined by one of ordinary skill in the art in view of the present disclosure by routine experimentation, for example. Any suitable biasing member well known to those of ordinary skill in the art can be used in the dancer arm assembly. An advantage of the present invention is that biasing members having different resistances can be readily interchanged to permit successive winding of a variety of packages of different tensions.

As shown in FIG. 13, the biasing member can comprise a compressible spring 68 having a predetermined spring constant. The spring 68 can be formed from, for example, carbon steel and stainless steel. The spring constant can be about 525 to about 2627 N/m (about 3 to about 15 pounds per inch), and depends upon such factors as the type and number of strands in the bundle to be wound and the desired tension in the resulting roving package, to name a few. The more strands, the higher the spring constant. For example, the spring constant for forming a package from a bundle having four ends is about 700 N/m (about 4 pounds per inch) and the spring constant for forming a package from a bundle having 31 ends is about 2627 N/m (about 15 pounds per inch). The preferred compressible spring 68 has a 2.477 cm (0.975 inch) outer diameter, a 10.16 cm (4 inch) uncompressed length and a spring constant of 1086 N/m (6.2 pounds per inch), and is commercially available from Diamond Wire Spring Co.

Alternatively, as shown in FIG. 14, the biasing member can be a pneumatic cylinder 168, which can be supplied with a fluid such as oil or, preferably, air, to bias the dancer arm 160 to a position between the switches 162, 164 corresponding to a desired tension in the bundle 112 for winding. The preferred air cylinder 168 has a 1.9 cm (¾ inch) diameter and a 2.54 cm (1 inch) stroke. The air pressure in the cylinder 168 is preferably adjusted to about 137895 $N/m^2$ (about 20 psi), although this pressure value can vary depending upon the desired tension to be maintained in the bundle 12.

A small volume of air is maintained between the air cylinder 168 and pressure regulator to dampen pressure variations which can occur as the dancer arm 160 moves up and down. Once the desired pressure is set, the dancer arm 160 is free to move between the switches 162, 164 in response to tension changes in the bundle 112 with minimal pressure fluctuations (less than about 6895 $N/m^2$ (about 1 psi)), thus delivering nearly constant bundle tension for roving package 116 build.

The feed device controller 54, 154 receives the signal from the tension sensing device and adjusts the speed of the feed device 36, 136 in response to the signal from the tension sensing device. In the alternative embodiment shown in FIG. 14, the tension sensing device sends a signal to the feed device controller 154 when the dancer arm 160 contacts either of the first or second switches 162, 164.

Referring now to FIGS. 1 and 2, the apparatus 10, 110 also comprises a winding device 38, 138 for advancing and applying a tension to the fiber bundle 12. The winding device 38, 138 comprises a rotatable packaging collector or collet 72, 172 about which the fiber bundle 12, 112 is wound to form a roving package 16, 116. Optionally, the roving package can be wound upon a tube 78, 178 which is removably telescoped onto the collet 72, 172. The winding device 38, 138 can be any conventional winder for winding standard roving packages, such as are discussed in K. Loewenstein, *The Manufacturing Technology of Continuous Glass Fibres* (2d Ed. 1983) at pages 317–323.

Preferably, the winding device 38, 138 comprises a collet support 74, 174 which pivots away from the winder traverse 76, 176 as the diameter of the roving package 16, 116 increases during winding. The collet 72, 172 is rotated by a variable speed motor (not shown). As the diameter of the roving package 16, 116 increases, the linear bundle speed is measured by a roll (not shown) using a tachometer (not shown) which signals the variable speed motor to adjust the motor speed to maintain essentially constant linear speed of the bundle 12 during winding. A preferred winding device 38, 138 is a LEESONA® 868 winder, which is commercially available from Leesona Division of John Brown Textile Machinery of Burlington, N.C.

The winding device 38, 138 also comprises a guide eye 70, 170 for orienting the bundle 12, 112 during movement of the traverse 76, 176 back and forth across the roving package 16, 116 during winding. If all strands 22, 122 remain in the same orientation during winding, those strands 22, 122 closest to the inside of the roving package 16, 116 are shorter than those on the outside of the package 16, 116. A guide eye 70, 170 having a 6.35 mm (¼ inch) circular aperture and a flat bundle parallel with the rotational axis of the collet 72, 172 minimize this problem. As the guide eye 70, 170 moves back and forth across the surface of the roving package 16, 116, the trailing edge of the flat bundle 12, 112 is positioned toward the inside of the roving package 16, 116.

The method according to the present invention for reducing catenary during winding of a fiber bundle will now be described generally.

With reference to FIGS. 1 and 2, the method generally comprises the initial step of applying substantially equal tension to each of a plurality of fiber strands 22, 122. The tension is applied to each of the strands 22, 122 by respective tensioning devices 30, 130. About 60 to about 120 grams of tension is applied to each of the fiber strands 22, 122. The tension being applied to each of the strands 22, 122 by the tensioning devices 30, 130 is maintained at substantially the same value by the tensioning device controller 32, 132.

The method further comprises a next step of gathering the plurality of fiber strands 22, 122 to form a bundle 12, 112 of generally parallel fiber strands 22, 122. In the preferred embodiment shown in FIG. 1, the plurality of fiber strands 22 are gathered into a bundle 12 by a pair of guide eyes 34, 35 and oscillated by a fiber oscillating device 33 across the outer, mating surfaces of the feed roll 40 and nip roll 42. In the alternative embodiment shown in FIG. 2, the strands 122 are gathered by the guide eye 134 positioned adjacent the entry to the feed device 136.

The method further comprises advancing the fiber bundle 12, 112 at a predetermined speed toward the winding device 38, 138. The fiber bundle 12, 112 is advanced by the feed roll 40, 140 and pressure is applied to the fiber bundle 12, 112 by the feed device 36, 136, preferably without wrapping of the fiber bundle around the feed roll 40, 140 or nip roll 42, 142. In the preferred embodiment, the feed device support carriage 83 is movable between a first position and a second position in a direction generally parallel to the bundle travel path in response to variations in tension. A signal can be provided to an operator 97 or the winding device 38 to cease winding if the tension in the bundle 12 is below or exceeds predetermined acceptable values.

The method further comprises a next step of measuring the tension of the fiber bundle 12, 112. In the preferred embodiment, the tension of the fiber bundle 12 is measured by a tension sensing device which provides a signal to the winding device 38. In the alternative embodiment, the tension of the fiber bundle 112 is measured by a tension sensing device which provides a signal to the feed device controller 154. The fiber bundle 12, 112 contacts the roll or spindle 66, 166 of the dancer arm assembly 58, 158. In the preferred embodiment, changes in the tension of the bundle 12 change the resistance of the dancer arm assembly 58. The change in resistance is measured by a potentiometer 62, which sends a signal to the winding device 38 to adjust the speed of the 10 winding device 38. In the alternative embodiment, if the tension in the fiber bundle 112 is less than a predetermined value, the dancer arm 160 contacts the first limit switch 162. If the tension in the fiber bundle 112 is greater than a second predetermined value, the dancer arm 160 contacts the second limit switch 164. When the dancer arm 160 contacts either the first limit switch 162 or second limit switch 164, a signal is sent to the feed device controller 154.

The method comprises adjusting the tension of the fiber bundle 12, 112 by adjusting the speed at which the fiber bundle 12, 112 is advanced, such that (1) the speed of advancement of the fiber bundle 12, 112 is increased when the measured tension of the bundle exceeds a predetermined value or (2) the speed of advancement of the fiber bundle 12, 112 is decreased when the measured tension of the bundle 12, 112 is less than a second predetermined value.

In the preferred embodiment, a signal is sent from the potentiometer 62 to the winding device 38 to increase the speed of the winding device 38 if the tension in the bundle is too low or decrease the speed of the winding device if the tension in the bundle is too high by increasing or decreasing the speed of the winder motor (not shown), respectively.

In the alternative embodiment, when the dancer arm 160 contacts the first limit switch 162, the tension sensing device provides a signal to the feed device controller 154 to decrease the speed at which the feed device 136 advances the fiber bundle 112 (i.e., decrease the motor 152 speed) and (2) when the dancer arm 160 contacts the second limit switch 164, the tension sensing device provides a signal to the feed device controller 154 to increase the speed at which the feed device 136 advances the fiber bundle 112 (i.e., increase the motor 152 speed).

The method further comprises winding the fiber bundle 12, 112 upon a rotatable packaging collector 72, 172 of a winding device 38, 138 to form a roving package 16, 116.

The method of the present invention is not limited to use in making roving packages, but can also be useful in any process in which a plurality of strands of material is gathered into a bundle and wound into a package.

The operation of the apparatuses 10, 110 to perform the method according to the present invention will now be described. However, other apparatus besides that shown and described herein could be used to perform the method of the present invention, if desired.

In the initial sequence of operation, the supply packages 20, 120 are positioned in the creel 28, 128 and each strand 22, 122 is threaded through its respective tensioning device 30, 130. In the preferred embodiment, the strands 22 are gathered and threaded through the guide eyes 34, 35 to form the bundle 12. In the alternative embodiment, the strands 122 are gathered and threaded through the guide eye 134 to form the bundle 112.

The bundle 12, 112 is passed between the feed roll 40, 140 and nip roll 42, 142, around a portion of the roll 66, 166 of the dancer arm 60, 160 and through the winding device 70, 170. In the preferred embodiment, the feed device support carriage is adjusted to bias itself to a neutral position at the desired bundle tension. The dancer arm 60 is also biased to a neutral position at the desired bundle tension. In the alternative embodiment, the dancer arm 160 is adjusted to bias the arm 160 to a neutral position between the first switch 162 and second switch 164 at the desired bundle tension.

Next, the tensioning device controller 32, 132 is activated to provide a predetermined voltage to each of the tensioning devices 30, 130. The winding device 38, 138 is activated and the nip roll 42, 142 is contacted with the feed roll 40 at a predetermined pressure. The regenerative DC motor 80 or feed device controller 154 is activated to provide a predetermined voltage to the motor 52, 152 to commence rotation of the feed roll 40, 140 and advancement of the fiber bundle 12, 112.

In the preferred embodiment, when a signal is received that the tension of the bundle 12 is above or below the desired range of acceptable tension values, the operator 97 can observe that the pointer or indicator 100 is positioned outside of the desired scale 105 or a signal can be sent to the operator 97 or winding device 38 to cease winding.

The tension sensing device also monitors the tension in the bundle 12, 112. In the preferred embodiment, when a signal is received that the resistance of the dancer arm 60 is below a predetermined value, indicating that the bundle 12 is being subjected to reduced tension, the tension sensing device signals the winding device 38 to decrease the speed of the winding device 38, thereby decreasing the rate of advancement of the fiber bundle 12. When a signal is received that the resistance of the dancer arm 60 exceeds a second predetermined value, indicating that the bundle 12 is being subjected to greater than the desired tension, the tension sensing device signals the winding device 38 to increase the speed of the winding device 38, thereby increasing the rate of advancement of the fiber bundle 12.

In the alternative embodiment, when a signal is received that the dancer arm 160 has contacted the first switch 162, indicating that the bundle 112 is being subjected to reduced tension, the tension sensing device signals the feed device controller 154 to decrease the speed of the motor 152, thereby decreasing the rotational speed of the feed roll 140 and the rate of advancement of the fiber bundle 112. When a signal is received that the dancer arm 160 has contacted the second switch 164, indicating that the bundle 112 is being subjected to greater than the desired tension, the tension sensing device signals the feed device controller 154 to increase the speed of the motor 152, thereby increasing the rotational speed of the feed roll 140 and the rate of advancement of the fiber bundle 112.

The tension sensing device continuously monitors the fiber bundle 12, 112 tension throughout the winding process and signals the either the winding device 38 or feed device controller 154 to increase or decrease the rate at which the fiber bundle 12, 112 is advanced to the winder, as necessary. When the roving package 16, 116 is completed, the winding device 38, 138 or operator signals the feed device controller 54, 154 and tensioning device controller 32, 132 to stop providing voltage to the feed roll 42, 142 and tensioning devices 30, 130 to cease the winding operation.

From the foregoing description, it can be seen that the present invention comprises a method and apparatus for reducing catenary during winding of a fiber bundle by reducing tension variations in the bundle and between the individual strands and non-uniform pull on the strands by the winder. By the method and apparatus of the present invention, static catenary of a fiber bundle having less than 15 fiber strands can be reduced to less than about 3.8 cm (about 1.5 inches) in a 15.2 m (50 foot) length of the bundle, as compared to typical sag of about 15 to about 30 cm (about 6 to about 12 inches) in a 15.2 m (50 foot) length of a bundle wound using conventional winding equipment and processes. The method and apparatus of the present invention reduce variations in package density, tangling during payout, package collapse and telescoping.

The method and apparatus of the present invention will now be illustrated by the following specific, non-limiting examples.

EXAMPLE 1

Each of the sample supply packages was wound with a K17.3 fiber glass strand. Each of the fiber glass strands of Samples A, C, D and E were coated with sizing compositions prepared according to U.S. Pat. No. 3,249,412. The fiber glass strands of Sample A are the commercially available roving product No. 1062 of PPG Industries, Inc. of Pittsburgh, Pa. The fiber glass strands of Samples C–E are the commercially available roving product No. 1064, also available from PPG Industries.

The fiber glass strands of Sample B are commercially available from PPG Industries as roving No. 712. These strands were coated with a sizing composition having an epoxy emulsion and modified epoxy emulsion, emulsifiers, silane coupling agents, a lubricant and a starch.

Each of the roving packages was prepared using the apparatus of the present invention described above, except each of the control roving packages was prepared using QUALTEX creel tension devices, standard, parallel ceramic friction type tensioning bars and the LEESONA 868 winder. For the roving packages prepared according to the present invention, the tension provided to each strand by the ACCUTENSE® tensioning devices was 90 grams. The linear speed of the bundle was 335 m/min (about 1100 ft/min).

For each of the roving packages 1–6 and the controls of Samples A and E, three (3) supply packages were creeled and the strands from those packages gathered to form the roving. The nip roll pressure for roving packages 1–6 was 137895 N/m$^2$ (20 psi).

For the roving packages and controls of Sample B, eight (8) supply packages were used to supply the strands for the bundle. The nip roll pressure for the roving packages prepared according to the present invention was 172369 N/m$^2$ (25 psi).

Fourteen (14) supply packages were used to supply the strands for the bundle for the roving packages and controls of Sample C. The nip roll pressure for the roving packages 1–6 was 275790 N/m$^2$ (40 psi).

For Sample D, four (4) supply packages were used to provide strands for the bundles. The nip roll pressure for the roving packages prepared according to the present invention for Sample D was 137895 N/m$^2$ (20 psi).

Static catenary tests were performed on each of the roving packages to determine the amount of catenary in a 15.2 m (fifty (50) foot) length of bundle. Three 15.2 m (fifty foot) samples were evaluated from randomly selected portions of each package. Each sample was pulled tight and weights were suspended from one supported end of the sample. For a sample having 31 ends, 1.1 kg (2½ pounds) of weight was attached to the supported end. For a sample having 16 or fewer ends, 0.45 kg (1 pound) of weight was attached to the supported end. The strands were then manually separated at the center of the 15.2 m (50 foot) sample. The amount of sag at the center of the bundle was measured. The static catenary values set forth in Table 1 are the averages of the three samples for each package.

TABLE 1

| SAMPLE NO. | ROVING PACKAGE NO. | STATIC CATENARY cm (in.) | FUZZ |
|---|---|---|---|
| A | 1 | 2.116 (0.833) | NONE |
| A | 2 | 2.54 (1.000) | |
| A | 3 | 2.743 (1.080) | |
| A | 4 | 3.386 (1.333) | |
| A | 5 | 3.386 (1.333) | |
| A | 6 | 2.54 (1.000) | |
| A | CONTROL | 9.525 (3.750) | |
| B | 1 | 6.553 (2.580) | NONE |
| B | 2 | 8.026 (3.160) | |
| B | 3 | 7.823 (3.080) | |
| B | 4 | 8.687 (3.420) | |
| B | 5 | 6.553 (2.580) | |
| B | 6 | 7.188 (2.830) | |
| B | CONTROL | 13.538 (5.330) | |
| C | 1 | 8.255 (3.250) | NONE |
| C | 2 | 8.026 (3.160) | |
| C | 3 | 8.255 (3.250) | |
| C | 4 | 9.525 (3.750) | |
| C | 5 | 6.985 (2.750) | |
| C | 6 | 6.985 (2.750) | |
| C | CONTROL | 12.7 (5.000) | |
| D | 1 | 3.378 (1.330) | NONE |
| D | 2 | 4.013 (1.580) | |
| D | 3 | 5.715 (2.250) | |
| D | 4 | 3.81 (1.500) | |
| D | 5 | 4.877 (1.920) | |
| D | 6 | 5.613 (2.210) | |
| D | CONTROL | 8.407 (3.310) | |
| E | 1 | 2.743 (1.080) | NONE |
| E | 2 | 2.54 (1.000) | |
| E | 3 | 5.08 (2.000) | |
| E | 4 | 2.743 (1.080) | |
| E | 5 | 3.607 (1.420) | |
| E | 6 | 2.946 (1.160) | |
| E | CONTROL | 16.0 (6.300) | |

EXAMPLE 2

Each of the samples of Example 2 were prepared in a similar manner to that set forth above in Example 1 using K17.3 fiber glass strand. Samples F and H are the commercially available 1062 product of PPG Industries. Sample G is the 712 product of PPG Industries.

The bundles of Sample F were prepared from three (3) strands; the bundles of Sample G from eight (8) strands; and the bundles of Sample H from nine (9) strands. The nip roll pressure applied to the bundles of the roving packages of Sample F was 137895 N/m$^2$ (20 psi); Sample G was 172369 N/m$^2$ (25 psi) and Sample H was 206843 N/m$^2$ (30 psi).

Both the controls and test samples 1–5 of Sample F were prepared according to the present invention, except that the test samples were wound upon standard winding tubes and no tubes were used to prepare the control packages. The packages of Sample G and the test samples of Sample H were also prepared according to the present invention. Each of these samples prepared according to present invention were prepared using an apparatus according to the present invention, except springs were substituted for the pneumatic cylinder of the dancer arm assembly. The controls of Sample H were prepared on the conventional apparatus discussed in Example 1. The values of static catenary for Samples F–H are set forth in Table 2.

TABLE 2

| SAMPLE NO. | ROVING PACKAGE NO. | STATIC CATENARY cm (in.) |
|---|---|---|
| F | CONTROL 1 | 2.3 (0.9) |
| F | CONTROL 2 | 4.1 (1.6) |
| F | CONTROL 3 | 4.3 (1.7) |
| F | CONTROL 4 | 3.6 (1.4) |
| F | CONTROL 5 | 3.1 (1.2) |
| F | 1 | 3.3 (1.3) |
| F | 2 | 4.8 (1.9) |
| F | 3 | 4.8 (1.9) |
| F | 4 | 3.8 (1.5) |
| F | 5 | 3.6 (1.4) |
| G | CONTROL 1 | 14.5 (5.7) |
| G | CONTROL 2 | 11.9 (4.7) |
| G | CONTROL 3 | 9.1 (3.6) |
| G | CONTROL 4 | 12.2 (4.8) |
| G | CONTROL 5 | 10.4 (4.1) |
| H | CONTROL 1 | 10.2 (4.0) |
| H | CONTROL 2 | 12.2 (4.8) |
| H | CONTROL 3 | 8.1 (3.2) |
| H | CONTROL 4 | 8.6 (3.4) |
| H | CONTROL 5 | 8.4 (3.3) |
| H | CONTROL 6 | 6.1 (2.4) |
| H | 1 | 3.8 (1.5) |
| H | 2 | 5.3 (2.1) |
| H | 3 | 3.3 (1.3) |
| H | 4 | 3.3 (1.3) |
| H | 5 | 5.3 (2.1) |
| H | 6 | 3.3 (1.3) |

EXAMPLE 3

Each of the samples of Example 3 were prepared in a similar manner to that set forth above in Example 1 using K17.3 fiber glass strand. Samples I–M are the commercially available 1064 product of PPG Industries.

The bundles of Sample I were prepared from three (3) strands; the bundles of Sample J from four (4) strands; and the bundles of Samples K–M from fourteen (14) strands. The nip roll pressure applied to the bundles of the roving packages of Sample I prepared according to the present invention was 137895 N/m$^2$ (20 psi). The nip roll pressures applied to the bundles of Samples J and K–M prepared according to the present invention were 137895 N/m$^2$ (20 psi) and 27590 N/m$^2$ (40 psi), respectively. Samples L and M were wound upon conventional winding tubes. Samples L and M were the twelfth (12th) and twenty-fourth (24th) roving packages wound on the apparatus to evaluate whether the bundle and package quality would deteriorate after a significant number of roving packages had been prepared on the apparatus of the present invention. No significant deterioration of the quality of either package was observed. The values of static catenary for Samples I–M are set forth in Table 3.

TABLE 3

| SAMPLE NO. | ROVING PACKAGE NO. | STATIC CATENARY cm (in.) | AVERAGE STATIC CATENARY cm (in.) |
|---|---|---|---|
| I | CONTROL 1 | 2.964 (1.167) | 3.302 (1.300) |
| I | CONTROL 2 | 4.021 (1.583) | |
| I | CONTROL 3 | 3.175 (1.250) | |
| I | CONTROL 4 | 3.175 (1.250) | |
| I | CONTROL 5 | 3.175 (1.250) | |
| I | 1 | 2.962 (1.166) | 3.132 (1.233) |
| I | 2 | 2.116 (0.833) | |
| I | 3 | 4.656 (1.833) | |
| I | 4 | 3.175 (1.250) | |
| I | 5 | 2.751 (1.083) | |
| J | CONTROL 1 | 10.16 (4.000) | 7.536 (2.967) |
| J | CONTROL 2 | 6.985 (2.750) | |
| J | CONTROL 3 | 7.196 (2.833) | |
| J | CONTROL 4 | 8.255 (3.250) | |
| J | CONTROL 5 | 5.08 (2.000) | |
| J | 1 | 4.021 (1.583) | 4.529 (1.783) |
| J | 2 | 4.656 (1.833) | |
| J | 3 | 4.656 (1.833) | |
| J | 4 | 3.81 (1.500) | |
| J | 5 | 5.504 (2.167) | |
| K | CONTROL 1 | 26.467 (10.42) | 21.719 (8.551) |
| K | CONTROL 2 | 16.51 (6.500) | |
| K | CONTROL 3 | 19.474 (7.667) | |
| K | CONTROL 4 | 23.495 (9.250) | |
| K | CONTROL 5 | 22.647 (8.916) | |
| K | 1 | 6.35 (2.500) | 6.307 (2.483) |
| K | 2 | 6.35 (2.500) | |
| K | 3 | 6.139 (2.417) | |
| K | 4 | 7.196 (2.833) | |
| K | 5 | 5.504 (2.167) | |
| L | — | 7.831 (3.083) | — |
| M | — | 7.62 (3.000) | — |

EXAMPLE 4

This example compares the static catenary levels for samples of conventional rovings using (1) QUALTEX creel tension devices, standard, parallel ceramic friction type tensioning bars and the LEESONA 868 winder ("Example A"); (2) the preferred apparatus of the present invention as shown in FIG. 1 ("Example B"); and (3) the alternative apparatus of the present invention shown in FIG. 2, further including the fiber oscillating device shown in FIGS. 6 and 7 ("Example C")

Each of the sample supply packages was wound with a K17.3 fiber glass strand. The fiber glass strands of Sample P are the commercially available roving product No. 1062 of PPG Industries, Inc. of Pittsburgh, Pa, which had a 433 yield and 4 strands or ends. The fiber glass strands of Sample Q are those used in the commercially available roving product No. 784 of PPG Industries, Inc., which has a 56 yield and 31 strands or ends.

For the roving packages prepared according to the present invention, the tension provided to each strand by the ACCUTENSE® tensioning devices was 90 grams for Examples B and C. The linear speed of the bundle in each Example was about 259 m/min (850 ft/min).

For each of the roving packages of Sample P, four (4) supply packages were creeled and the strands from those packages gathered to form the roving. The nip roll pressure for Example B was 172369 N/m$^2$ (25 psi) and the spring for the dancer arm assembly had a spring constant of 700.4 N/m (4.0 pounds per inch). The nip roll pressure for Example C was 172369 N/m$^2$ (25 psi) and the cylinder pressure for the dancer arm assembly was 68948 N/m$^2$ (10 psi).

For the roving packages and controls of Sample Q, thirty-one (31) supply packages were used to supply the strands for the bundle. The nip roll pressure for Example B was 344738 $N/m^2$ (50 psi) and the spring for the dancer arm assembly had a spring constant of 2539 N/m (14.5 pounds per inch). The nip roll pressure for Example C was 27590–310264 $N/m^2$ (40–45 psi) and the cylinder pressure for the dancer arm assembly was 206843 $N/M^2$ (30 psi).

Static catenary tests were performed on each of the resulting roving packages to determine the amount of catenary in a 15.2 m (fifty (50) foot) length of bundle in the manner set forth above for Example 1. The results of these static catenary tests are set forth in FIG. 18.

Figure 18:
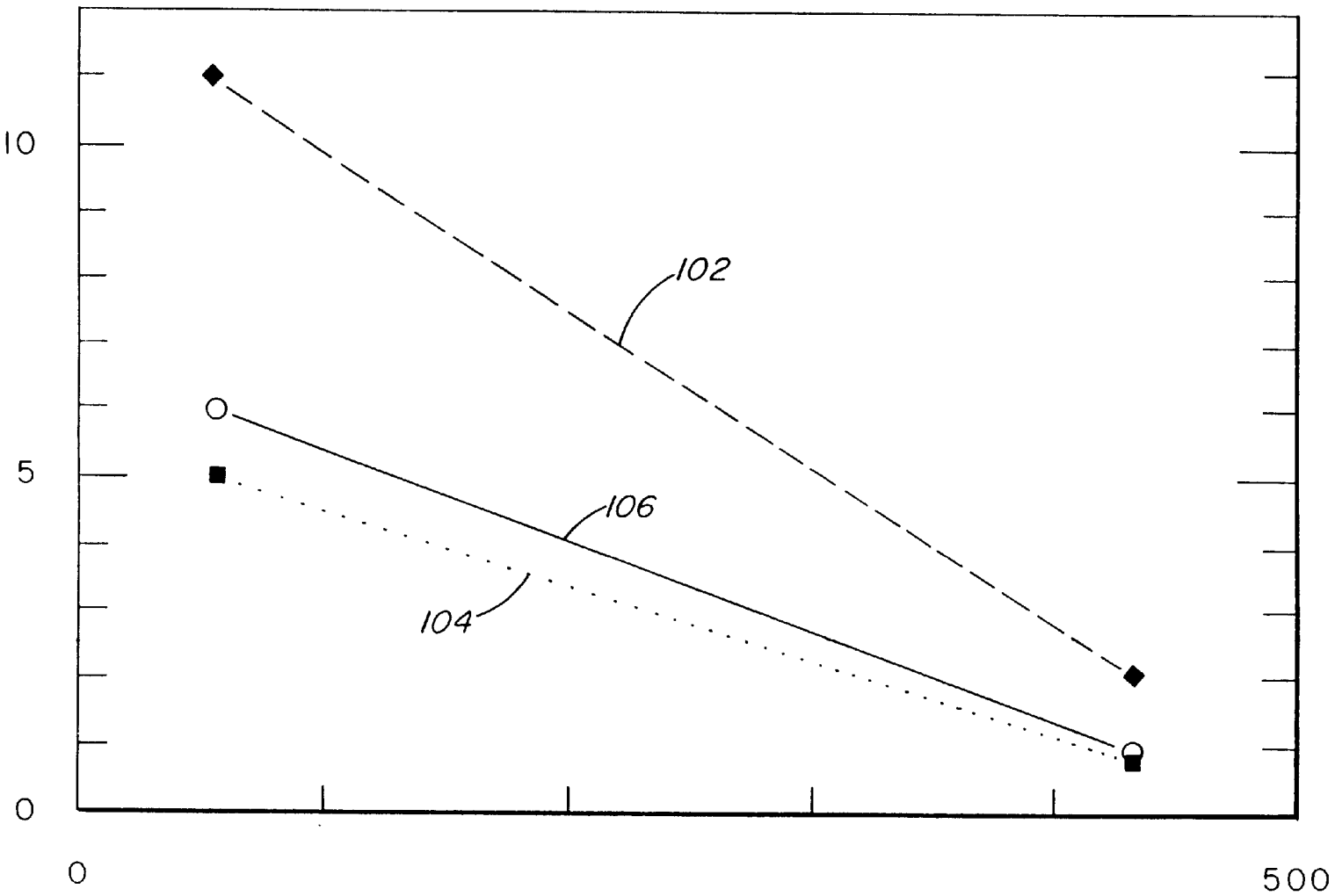
FIG. 18 is a graph of catenary in inches as a function of yield in yards per pound of fiber glass.

The static catenary values for Example A are shown by the dashed line 102 in FIG. 18. For Sample P having a 433 yield and 4 ends, the static catenary was about 5.08 cm (about 2 inches). For Sample Q having a 56 yield and 31 ends, the static catenary was about 27.94 cm (about 11 inches).

The static catenary values for Example B according to the present invention are shown by the dotted line 104 in FIG. 18. For Sample P having a 433 yield and 4 ends, the static catenary was 2.54 cm (about 1 inch). For Sample Q having a 56 yield and 31 ends, the static catenary was 12.7 cm (about 5 inches).

The static catenary values for Example C, also according to the present invention, are shown by the solid line 106 in FIG. 18. For Sample P having a 433 yield and 4 ends, the static catenary was about 2.54 cm (about 1 inch). For Sample Q having a 56 yield and 31 ends, the static catenary was about 15.24 cm (about 6 inches).

Each of the foregoing Examples clearly shows that use of the method and/or apparatus of the present invention significantly reduces static catenary during winding of a bundle of strands into a roving package.

It will be appreciated by those skilled in the art that changes could be made to the embodiments described above without departing from the broad inventive concept thereof. It is understood, therefore, that this invention is not limited to the particular embodiments disclosed, but it is intended to cover modifications which are within the spirit and scope of the invention, as defined by the appended claims.

Therefore, we claim:

1. An apparatus (110) for reducing catenary during winding of a fiber bundle (112) to form a package (116), the fiber bundle (112) comprising a plurality of fiber strands (122), characterized by:

(a) a frame (126) adapted to support a plurality of fiber strand supply packages (120) and a plurality of tensioning devices (130);

(b) the plurality of fiber strand supply packages (120), each supply package (120) permitting withdrawal of a fiber strand of the plurality of fiber strands (122) wound thereon;

(c) the plurality of tensioning devices (130), each tensioning device receiving the fiber strand of the plurality of fiber strands (122) withdrawn from a supply package of the plurality of fiber strand supply packages (120) and applying a tension to the fiber strand of the plurality of fiber strands (122), wherein the tension applied to each of the fiber strands of the plurality of fiber strands (122) is substantially equal;

(d) a gathering device (134) spaced apart from each of the plurality of tensioning devices (130) for gathering the plurality of substantially equally tensioned fiber strands (122) into the fiber bundle (112);

(e) a feed device (136) spaced apart from the frame (126) for receiving the fiber bundle (112) from the gathering device and advancing the fiber bundle (112) at a predetermined speed to a winding device (138);

(f) the winding device (138) spaced apart from the feed device (136), the winding device (138) comprising a rotatable packaging collector (172) about which the fiber bundle (112) is wound to form the package (116), the winding device (138) receiving the bundle (112) from the feed device (136) and applying a tension to the bundle (112);

(g) a tension sensing device positioned between the feed device (136) and the winding device (138) for determining the tension in the bundle (112) after the bundle (112) is advanced by the feed device (136) to the winding device (138), the tension sensing device (136) providing a signal to a feed device controller (154); and (h) the feed device controller (154) electrically connected to the tension sensing device for receiving the signal from the tension sensing device and adjusting the tension of the bundle (112) by (1) decreasing the speed at which the feed device (136) advances the fiber bundle (112) when the tension is less than a first predetermined value and (2) increasing the speed at which the feed device (136) advances the fiber bundle (112) when the tension exceeds a second predetermined value in response to the signal from the tension sensing device, such that catenary of the fiber bundle (112) is minimized during winding.

2. The apparatus according to claim 1, wherein the fibers are glass fibers.

3. The apparatus according to claim 1, wherein at least one of the tensioning devices comprises a magnetic hysteresis brake (210).

4. The apparatus according to claim 1, wherein each of the tensioning devices applies about 60 to about 120 grams of tension to each of the fiber strands (122).

5. The apparatus according to claim 1, wherein at least one of the tensioning devices comprises a unitary, resilient strand engaging wheel (212) comprising a generally annular body (218) including opposing sidewalls (220,222) having a plurality of alternating, spaced-apart, tapered strand gripping abutments (226) projecting inwardly from the periphery (227) of the strand engaging wheel (212) to provide a serpentine strand path (228), a portion of each sidewall (220,222) between the abutments (226) having an opening (236) for providing access to the serpentine strand path (228).

6. The apparatus according to claim 5, wherein the serpentine strand path (228) is less than about 20 percent discontinuous.

7. The apparatus according to claim 5, wherein at least one abutment (226) spans from about 5 to about 10 percent of the strand path (228).

8. The apparatus according to claim 1, further comprising a tension device controller (132) for regulating power to each of the plurality of tensioning devices (130) to minimize variations in the tension applied to each of the fiber strands (122) of the bundle (112).

9. The apparatus according to claim 8, wherein the tension device controller (132) regulates the plurality of tensioning devices (130) such that the variation in tension between each of the strands (122) is less than about 10 grams.

10. The apparatus according to claim 1, wherein the gathering device comprises a gathering guide eye (134).

11. The apparatus according to claim 1, wherein the gathering device comprises a fiber bundle oscillating device (33) for oscillating the fiber bundle (112) across at least a portion of an outer surface (144) of a driven feed roll (140) and a corresponding portion of an outer surface of a nip roll (142).

12. The apparatus according to claim 1, wherein the feed device (136) comprises a feed device support (129) having mounted thereon a driven feed roll (140), an opposed nip roll (142), and a nip roll pressurizing device, the driven feed roll (140) having an axis of rotation (146) which is generally parallel and coplanar to an axis of rotation (148) of the nip roll (142), the nip roll pressurizing device engaging the nip roll (142) and applying pressure to bias an outer surface of the nip roll (142) against an outer surface of the feed roll (140) to apply pressure to a portion of the bundle passing therebetween.

13. The apparatus according to claim 12, wherein the driven feed roll (140) further comprises a drive device selected from the group consisting of a direct current regenerative drive and an alternating current drive having dynamic braking.

14. The apparatus according to claim 12, wherein the nip roll pressurizing device applies about 68948 to about 413686 $N/m^2$ (about 10 to about 60 psi) pressure to the bundle.

15. The apparatus according to claim 12, wherein the nip roll (142) is opposed to the drive roll (140) to advance the fiber bundle (112) without wrapping of the bundle (112) around the drive roll (140).

16. The apparatus according to claim 12, wherein the feed device further comprises a stationary frame (13) having a guide rail member (15) and a biasing member (75), the feed device support further comprising a feed device support carriage (83) having mounted thereon the driven feed roll (140), the nip roll (142), and the nip roll pressurizing device, the feed device support carriage (83) being slidably secured to the guide rail member (15) of the stationary frame (13) by the biasing member (75), such that the feed device support carriage (83) is movable alone a length of the guide rail member (15) between a first position (87) and a second position (89).

17. The apparatus according to claim 16, wherein the biasing member (75) comprises a compressible spring (77) having a predetermined spring constant.

18. The apparatus according to claim 16, wherein the feed device support carriage (83) is movable along a length (85) of the guide rail member (15) between a first position (87) and a second position (89), such that (1) when the tension of the fiber bundle exceeds a predetermined value, the feed device support carriage (83) moves to the first position (87) and (2) when the tension of the fiber bundle is less than the predetermined value, the feed device support carriage (83) moves to the second position (89).

19. The apparatus according to claim 18, wherein the feed device support carriage (83) contacts (1) a first sensing device (91) when the tension of the fiber bundle exceeds the second predetermined value which is greater than the first predetermined value and (2) a second sensing device (93) when the tension of the fiber bundle is less than a third predetermined value which is less than the first predetermined value.

20. The apparatus according to claim 19, wherein when the tension of the fiber bundle (112) exceeds the second predetermined value, the first sensing device (91) provides a signal (95) to at least one of an operator (97) and the winder device (138) to deactivate the winding device (138).

21. The apparatus according to claim 19, wherein when the tension of the fiber bundle (112) is less than the third predetermined value, the second sensing device (93) provides a signal (101) to at least one of an operator (97) and the winder device (138) to deactivate the winding device (138).

22. The apparatus according to claim 19, wherein at least one of the first sensing device (91) and the second sensing device (93) is a limit switch.

23. The apparatus according to claim 1, wherein the tension sensing device comprises a housing (159) having a dancer arm assembly (158) mounted thereon, the dancer arm assembly comprising a pivotable dancer arm (160) and a resistance sensing device, the pivotable dancer arm (160) having two opposing ends and a rotatable roll (66), the rotatable roll being located at the first end of the pivotable dancer arm (160) for engaging a portion of the fiber bundle (112), the dancer arm (160) being pivotable between a first position and a second position, such that (1) when the tension of the bundle (112) is less than the first predetermined value, the dancer arm (160) pivots to the first position, the resistance sensing device senses the resistance of the dancer arm (160) in the first position and provides a first signal to the tension sensing device, and the tension sensing device provides a second signal to the feed device controller (154) to decrease the speed at which the feed device advances the fiber bundle (112) and (2) when the tension of the bundle exceeds the second predetermined value, the dancer arm (160) pivots to the second position, the resistance sensing device senses the resistance of the dancer arm (160) in the second position and provides a third signal to the tension sensing device, and the tension sensing device provides a fourth signal to the feed device controller (154) to increase the speed at which the feed device (136) advances the fiber bundle (112).

24. The apparatus according to claim 23, wherein the resistance sensing device is a potentiometer (62).

25. The apparatus according to claim 23, wherein the dancer arm assembly (158) further comprises a biasing member for providing a predetermined resistance to the tension of the bundle (112).

26. The apparatus according to claim 25, wherein the biasing member comprises a compressible spring (63) having a predetermined spring constant.

27. The apparatus according to claim 1, wherein the tension sensing device comprises a housing (159) having a dancer arm assembly (158) mounted thereon, the dancer arm assembly (158) comprising a pivotable dancer arm (160), a first sensing device (162) and a second sensing device (164), the pivotable dancer arm (160) having two opposing ends and a rotatable roll, the rotatable roll being located at the first end of the pivotable dancer arm for engaging a portion of the fiber bundle (112), the second, opposite end having a first side and a second side, the dancer arm being pivotable between a first position in which the first side of the second end of the dancer arm contacts the first sensing device (162) and a second position in which the second side of the second end of the dancer arm contacts the second sensing device (164), such that (1) when the tension of the bundle is less than the first predetermined value, the first side of the second end of the dancer arm contacts the first sensing device (162) and the tension sensing device provides a signal (109) to the feed device controller (154) to decrease the speed at which the feed device (136) advances the fiber bundle (112) and (2) when the tension of the bundle exceeds the second predetermined value, the second side of the second end of the dancer arm contacts the second sensing device (164) and the tension sensing device provides a signal to the feed device controller (154) to increase the speed at which the feed device (136) advances the fiber bundle (112).

28. The apparatus according to claim 27, wherein the dancer arm assembly (158) further comprises a biasing member for providing a predetermined resistance to the tension of the bundle.

29. The apparatus according to claim 28, wherein the biasing member comprises a piston and cylinder arrangement (168).

30. The apparatus according to claim 1, wherein the feed device (136) advances the fiber bundle at a speed of about 244 to about 366 m/min (about 800 to about 1200 ft/min).

31. The apparatus according to claim 1, wherein the feed device (136) supplies a tension to the fiber bundle of up to about 8 Newtons (about 1.8 pounds) when the number of fiber strands in the bundle is less than 30.

32. The apparatus according to claim 1, wherein the feed device (136) supplies a tension to the fiber bundle of at least 12 Newtons (about 2.7 pounds) when the number of fiber strands in the bundle greater than 30 and a nip roll pressure is 413686 $N/m^2$ (about 60 psi).

33. The apparatus according to claim 1, wherein the fiber bundle (112) of the package produced by the winding device has less than 15 fiber strands and a static catenary of less than 3.81 centimeters (about 1.5 inches) in a 15.2 meters (50 foot) length of the bundle.

34. An apparatus (10) for reducing catenary during winding of a fiber bundle (12) to form a package (16), the fiber bundle (12) comprising a plurality of fiber strands (22), characterized by:

(a) a frame (26) adapted to support a plurality of fiber strand supply packages (20) and a plurality of tensioning devices (30);

(b) the plurality of fiber strand supply packages (20), each supply package (20) permitting withdrawal of a fiber strand of the plurality of fiber strands (22) wound thereon;

(c) the plurality of tensioning devices (30), each tensioning device (30) receiving the fiber strand of the plurality of fiber strands (22) withdrawn from a supply package of the plurality of fiber strand supply packages (20) and applying a tension to the fiber strand, wherein the tension applied to each of the fiber strands of the plurality of fiber strands is substantially equal;

(d) a gathering device (33) spaced apart from each of the plurality of tensioning devices (30) for gathering the plurality of substantially equally tensioned fiber strands (22) into the fiber bundle (12);

(e) a feed device (36) spaced apart from the frame (26) for receiving the fiber bundle (12) from the gathering device (33) and advancing the fiber bundle (12) at a predetermined speed to a winding device (38), the feed device (36) comprising (1) a stationary frame (13) having a guide rail member (15) and a biasing member (75) and (2) a feed device support (29) including a feed device support carriage (83) having mounted thereon a driven feed roll (40), a nip roll (42), and a nip roll pressurizing device (56), the driven feed roll (40) having an axis of rotation (46) which is generally parallel and coplanar to an axis of rotation (48) of the nip roll (42), the nip roll pressurizing device (56) engaging the nip roll (42) and applying pressure to bias an outer surface of the nip roll (42) against an outer surface (44) of the feed roll (40) to apply pressure to a portion of the bundle (12) passing therebetween, the feed device support carriage (83) being slidably secured to the guide rail member(15);

(f) the winding device (38) spaced apart from the feed device (36), the winding device (38) comprising a rotatable packaging collector (72) about which the fiber bundle (12) is wound to form the package (16), the winding device (38) receiving the bundle (12) from the feed device (36) and applying a tension to the bundle; and (g) a tension sensing device positioned between the feed device (36) and the winding device (38) for determining the tension in the bundle (12) after the bundle is advanced by the feed device to the winding device, the tension sensing device providing a signal (107) to the winding device (38), the winding device (38) receiving the signal (107) from the tension sensing device and adjusting a rotational speed of the packaging collector (72) in response to the signal (107) received from the tension sensing device.

35. An apparatus (10) for reducing catenary during winding of a fiber bundle (12) to form a package (16), the fiber bundle (12) comprising a plurality of fiber strands (22), characterized by:

(a) a frame (26) adapted to support a plurality of fiber strand supply packages (20) and a plurality of tensioning devices (30);

(b) the plurality of fiber strand supply packages (20), each supply package (20) permitting withdrawal of a fiber strand of the plurality of fiber strands (22) wound thereon;

(c) the plurality of tensioning devices (30), each tensioning device (30) receiving the fiber strand of the plurality of fiber strands (22) withdrawn from a supply package (20) of the plurality of fiber strand supply packages and applying a tension to the fiber strand (22), wherein the tension applied to each of the fiber strands of the plurality of fiber strands (22) is substantially equal;

(d) a gathering device (33) spaced apart from each of the plurality of tensioning devices (30) for gathering the plurality of substantially equally tensioned fiber strands (22) into a fiber bundle (12);

(e) a feed device (36) spaced apart from the frame (26) for receiving the fiber bundle (12) from the gathering device (33) and advancing the fiber bundle (12) at a predetermined speed to a winding device (38), the feed device (36) comprising a feed device support (29) having mounted thereon a driven feed roll (40), a nip roll (42), and a nip roll pressurizing device, the driven feed roll (40) having an axis of rotation (46) which is generally parallel and coplanar to an axis of rotation (48) of the nip roll (42), the nip roll pressurizing device engaging the nip roll (42) and applying pressure to bias an outer surface of the nip roll (42) against an outer surface (44) of the feed roll (40) to apply pressure to a portion of the bundle (12) passing therebetween, the driven feed roll (40) including a drive device (80) selected from the group consisting of a direct current regenerative drive and an alternating current drive having dynamic braking;

(f) the winding device (38) spaced apart from the feed device (36), the winding device (38) comprising a rotatable packaging collector (72) about which the fiber bundle (12) is wound to form the package (16), the winding device (38) receiving the bundle (12) from the feed device (38) and applying a tension to the bundle (12); and (g) a tension sensing device positioned between the feed device (36) and the winding device (38) for determining the tension in the bundle (12) after the bundle is advanced by the feed device (36) to the winding device (38), the tension sensing device providing a signal (107) to the winding device (38), the winding device (38) receiving the signal (107) from the tension sensing device and adjusting by (1) decreasing the rotational speed of the packaging collector (72) when the tension is less than a first predetermined value and (2) increasing the rotational speed of the packaging collector (72) when the tension exceeds a second predetermined value in response to the signal (107) received from the tension sensing device, such that catenary of the fiber bundle is minimized.

36. A method for reducing catenary during winding of a fiber bundle, the fiber bundle (12) comprising a plurality of fiber strands (22), the method characterized by:

(a) applying substantially equal tension to each of the plurality of fiber strands (22);

(b) gathering the plurality of fiber strands (22) to form the bundle (12) of generally parallel fiber strands (22);

(c) advancing the fiber bundle (12) at a predetermined speed and tension toward a winding device (38);

(d) measuring the tension of the fiber bundle (12);

(e) adjusting the tension of the fiber bundle (12) by adjusting the speed at which the fiber bundle (12) is advanced, such that (1) the speed of advancement of the fiber bundle (12) is increased when the measured tension of the bundle (12) exceeds a predetermined value and (2) the speed of advancement of the fiber bundle (12) is decreased when the measured tension of the bundle (12) is less than a second predetermined value; and (f) winding the bundle (12) upon a rotatable packaging collector (72) of a winding device (38) to form a package (16) having minimum catenary.

37. The method according to claim 36, wherein the fibers are glass fibers.

38. The method according to claim 36, wherein about 60 to about 120 grams of tension is applied to each of the fiber strands (22) in step (a).

39. The method according to claim 36, further comprising applying pressure to the fiber bundle (12) in step (c).

40. The method according to claim 36, wherein step (c) further comprises advancing the fiber bundle (12) without wrapping of the fiber bundle (12) around a feed device (38).

41. The method according to claim 36, further comprising contacting a portion of the fiber bundle (12) with at least a portion of a dancer arm (60) for measuring the tension in the bundle, such that the dancer arm (60) is moved to a first position when the measured tension of the bundle (12) is less than a predetermined value and to a second position when the measured tension of the bundle (12) exceeds a second predetermined value.

* * * * *